US010611145B2

(12) United States Patent
Yonehara et al.

(10) Patent No.: US 10,611,145 B2
(45) Date of Patent: Apr. 7, 2020

(54) LIQUID JET HEAD, LIQUID JET RECORDING DEVICE, METHOD FOR DRIVING LIQUID JET HEAD, AND PROGRAM FOR DRIVING LIQUID JET HEAD

(71) Applicant: SII Printek Inc., Chiba-shi, Chiba (JP)

(72) Inventors: Tasuku Yonehara, Chiba (JP); Yuki Yamamura, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 16/223,516

(22) Filed: Dec. 18, 2018

(65) Prior Publication Data

US 2019/0184699 A1 Jun. 20, 2019

(30) Foreign Application Priority Data

Dec. 20, 2017 (JP) ..... 2017-244097

(51) Int. Cl.
*B41J 2/045* (2006.01)
*B41J 2/14* (2006.01)

(52) U.S. Cl.
CPC ..... *B41J 2/04573* (2013.01); *B41J 2/04525* (2013.01); *B41J 2/04543* (2013.01); *B41J 2/04581* (2013.01); *B41J 2/04588* (2013.01); *B41J 2/04595* (2013.01); *B41J 2/14209* (2013.01); *B41J 2202/10* (2013.01); *B41J 2202/12* (2013.01)

(58) Field of Classification Search
CPC ..... B41J 2/04573; B41J 2/04581; B41J 2/14209; B41J 2/04595; B41J 2/04588; B41J 2/04543; B41J 2/04525; B41J 2202/12; B41J 2202/10
See application file for complete search history.

(56) References Cited

U.S. PATENT DOCUMENTS

2005/0073537 A1 4/2005 Iwao

FOREIGN PATENT DOCUMENTS

EP 2851200 A2 3/2015
EP 3118000 A1 1/2017
JP 2001-246738 A 9/2001

OTHER PUBLICATIONS

IP.com search (Year: 2019).*
Extended European Search Report in Europe Application No. 18214812.2, dated Apr. 23, 2019, 9 pages.

* cited by examiner

*Primary Examiner* — Lisa Solomon
(74) *Attorney, Agent, or Firm* — Brinks Gilson & Lione

(57) ABSTRACT

A liquid jet head includes a plurality of nozzles adapted to jet liquid, a piezoelectric actuator having a plurality of pressure chambers communicated individually with the nozzles and each filled with the liquid, and adapted to change a capacity of each of the pressure chambers, and a control section adapted to apply at least one pulse signal to the piezoelectric actuator to thereby expand and contract the capacity of the pressure chambers to jet the liquid filling the pressure chamber. The pressure chambers adjacent to each other of the plurality of the pressure chambers are set so as to belong to a plurality of groups different from each other. The control section makes the pulse signals different in timing between the plurality of groups and sets a shift amount of the timing in the pulse signals between the respective groups.

15 Claims, 17 Drawing Sheets t13
Sp1
Ton
Vd

G1 (Go)
(da)
(ON)
(db)
Δtd(<0)
t14
Sp2
Ton
Vd

G2 (Ge)
(da)
(ON)
(db)
t11
t12
Δtd(>0)
Sp2
Ton
Vd

G2 (Ge)
(da)
(ON)
(db)
t15
t16
t13
t

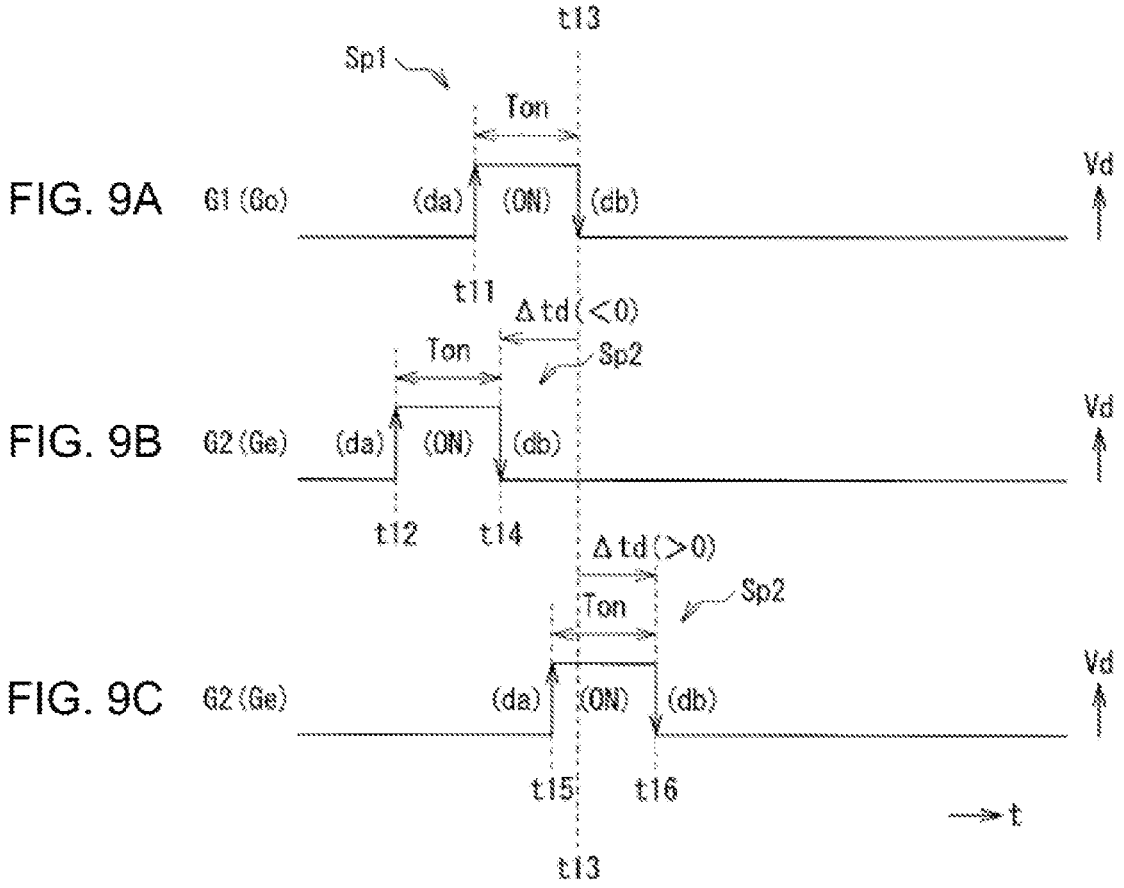
FIG. 9A
FIG. 9B
FIG. 9C
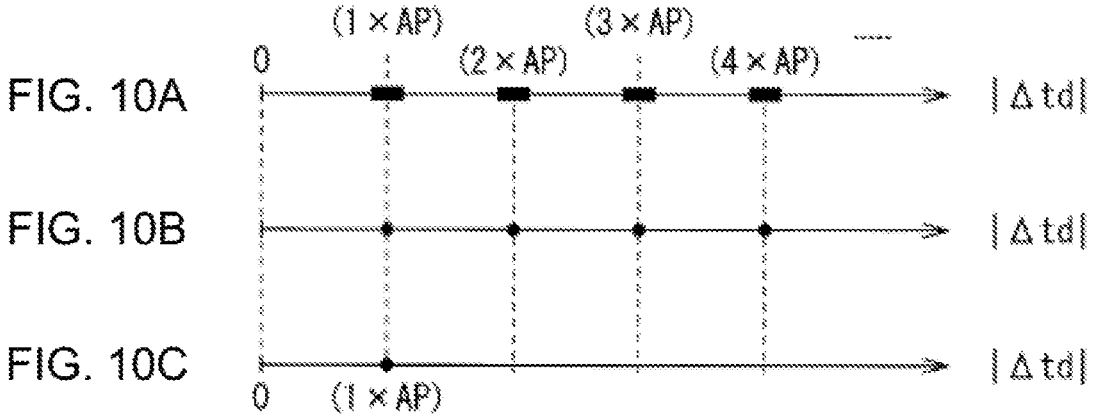
FIG. 10A
FIG. 10B
FIG. 10C

FIG. 15A (Sp101)
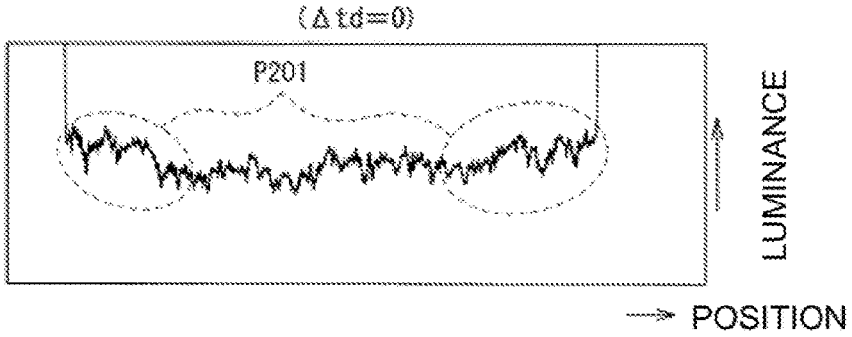
FIG. 15B (Sp1, Sp2)
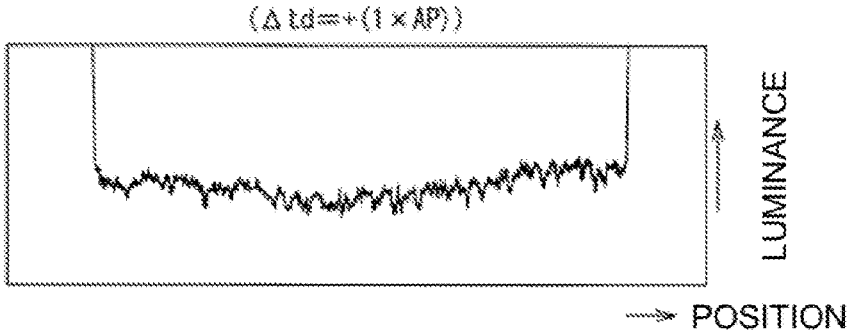
FIG. 15C (Sp1, Sp2)
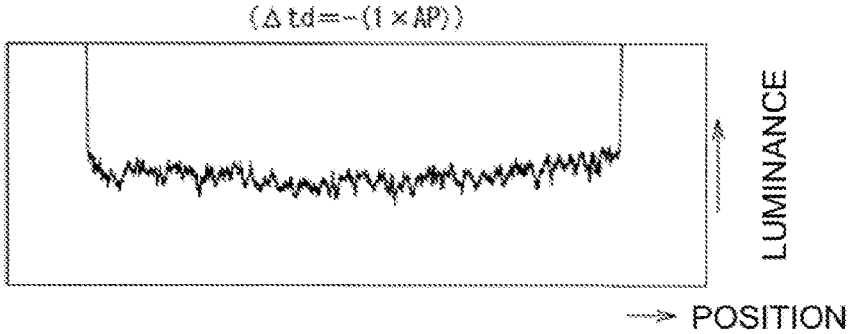

| DROPLET SIZE Sd (PLURALITY OF LEVELS) | PRESENCE OR ABSENCE OF SHIFT AMOUNT Δtd |
|---|---|
| $Sd < Sth$ | PRESENT ($\Delta td \neq 0$) |
| $Sd \geqq Sth$ | ABSENT ($\Delta td = 0$) |

FIG. 16

| JET TIMING OF INK 9 DUE TO SETTING OF Δtd | JETTING SPEED V9 OF INK 9 (WAVEFORM ADJUSTMENT OF Sp1, Sp2) |
|---|---|
| GROUP TO BE ACCELERATED | DECREASE |
| GROUP TO BE DELAYED | INCREASE |

FIG. 17

FIG. 20A (Sp101)
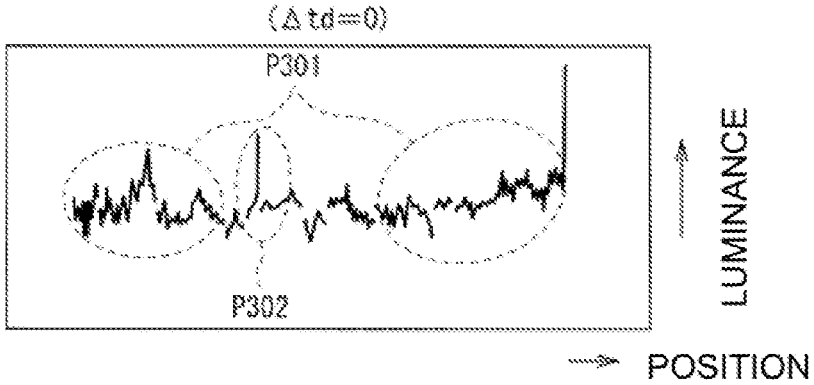
FIG. 20B (Sp1, Sp2)
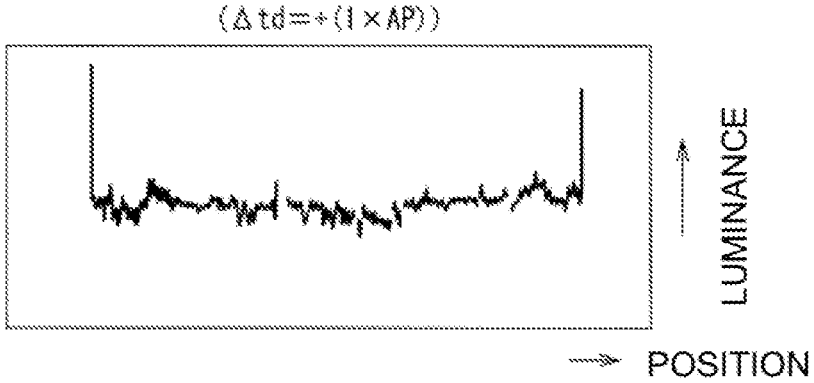
FIG. 20C (Sp1, Sp2)
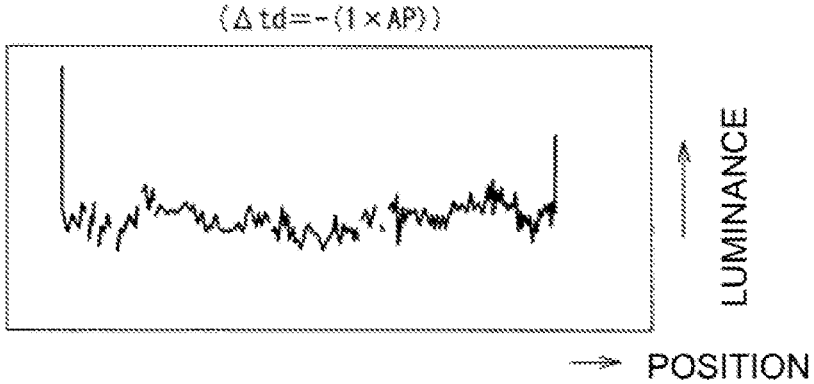

LIQUID JET HEAD, LIQUID JET RECORDING DEVICE, METHOD FOR DRIVING LIQUID JET HEAD, AND PROGRAM FOR DRIVING LIQUID JET HEAD

RELATED APPLICATIONS

This application claims priority under 35 U.S.C. § 119 to Japanese Patent Application No. 2017-244097 filed on Dec. 20, 2017, the entire content of which is hereby incorporated by reference.

BACKGROUND OF THE INVENTION

1. Field of the Invention

The present disclosure relates to a liquid jet head, a liquid jet recording device, a method for driving a liquid jet head, and a program for driving a liquid jet head.

2. Description of the Related Art

A liquid jet recording device equipped with a liquid jet head is used in a variety of fields.

In the liquid jet head, it is arranged that the capacity (volume) of a pressure chamber varies in accordance with application of a pulse signal to a piezoelectric actuator, and thus, a liquid filling the pressure chamber is jetted from a nozzle (see, e.g., JP-A-2001-246738).

In such a liquid jet head, in general, it is required to improve the printed image quality. It is desirable to provide a liquid jet head, a liquid jet recording device, a method for driving the liquid jet head, and a program for driving the liquid jet head each capable of improving the printed image quality.

SUMMARY OF THE INVENTION

The liquid jet head according to an embodiment of the present disclosure is provided with a plurality of nozzles adapted to jet liquid, a piezoelectric actuator having a plurality of pressure chambers communicated individually with the nozzles and each filled with the liquid, and adapted to change a capacity of each of the pressure chambers, and a control section adapted to apply at least one pulse signal to the piezoelectric actuator to thereby expand and contract the capacity of the pressure chambers to jet the liquid filling the pressure chamber. The pressure chambers adjacent to each other in the plurality of the pressure chambers are set so as to belong to a plurality of groups different from each other. The control section makes the pulse signals different in timing between the plurality of groups and sets a shift amount of the timing in the pulse signals between the respective groups so as to approximate an integral multiple of an on-pulse peak (AP) when jetting the liquid.

The liquid jet recording device according to an embodiment of the present disclosure is equipped with the liquid jet head according to an embodiment of the present disclosure described above.

The method for driving a liquid jet head according to an embodiment of the present disclosure includes the steps of setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other, and making the pulse signals different in timing between the plurality of groups and setting a shift amount of the timing in the pulse signals between the respective groups so as to approximate an integral multiple of an on-pulse peak (AP).

The program for driving a liquid jet head according to an embodiment of the present disclosure is adapted to make a computer perform a process including the steps of setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other, and making the pulse signals different in timing between the plurality of groups and setting a shift amount of the timing in the pulse signals between the respective groups so as to approximate an integral multiple of an on-pulse peak (AP).

According to the liquid jet head, the liquid jet recording device, the method for driving the liquid jet head, and the program for driving the liquid jet head related to the embodiment of the present disclosure, it becomes possible to improve the printed image quality.

BRIEF DESCRIPTION OF THE DRAWINGS

FIGS. 9A through 9C are schematic waveform charts showing another example of the shift amount between the pulse signals of the respective groups related to the embodiment.

FIGS. 10A through 10C are schematic diagrams for explaining a setting example of values of the shift amounts shown in FIGS. 8A through 8C and FIGS. 9A through 9C.

FIGS. 15A through 15C are diagrams showing an experimental result the luminance related to Modified Example 1 and a comparative example.

FIG. 16 is a diagram showing a setting example of a shift amount between pulse signals of respective groups related to Modified Example 2 in the form of a table.

FIG. 17 is a diagram showing an adjustment example of the jetting speed of a liquid related to Modified Example 3.

FIGS. 20A through 20C are diagrams showing an experimental result of the luminance related to Modified Example 4 and a comparative example.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example of the case of applying only a single pulse signal)
2. Modified Examples Modified Example 1 (an example of the case of applying a plurality of pulse signals)

Modified Example 2 (an example of the case of setting presence or absence of the shift amount in accordance with the volume of the droplet size)

Modified Example 3 (an example of the case of adjusting the jetting speed of the liquid in accordance with the jet timing of a liquid)

Modified Example 4 (an example of the case of a structure for supplying a liquid commonly to a plurality of columns of pressure chambers)

3. Other Modified Examples

1. Embodiment

[Overall Configuration of Printer 1]

Figure 1:
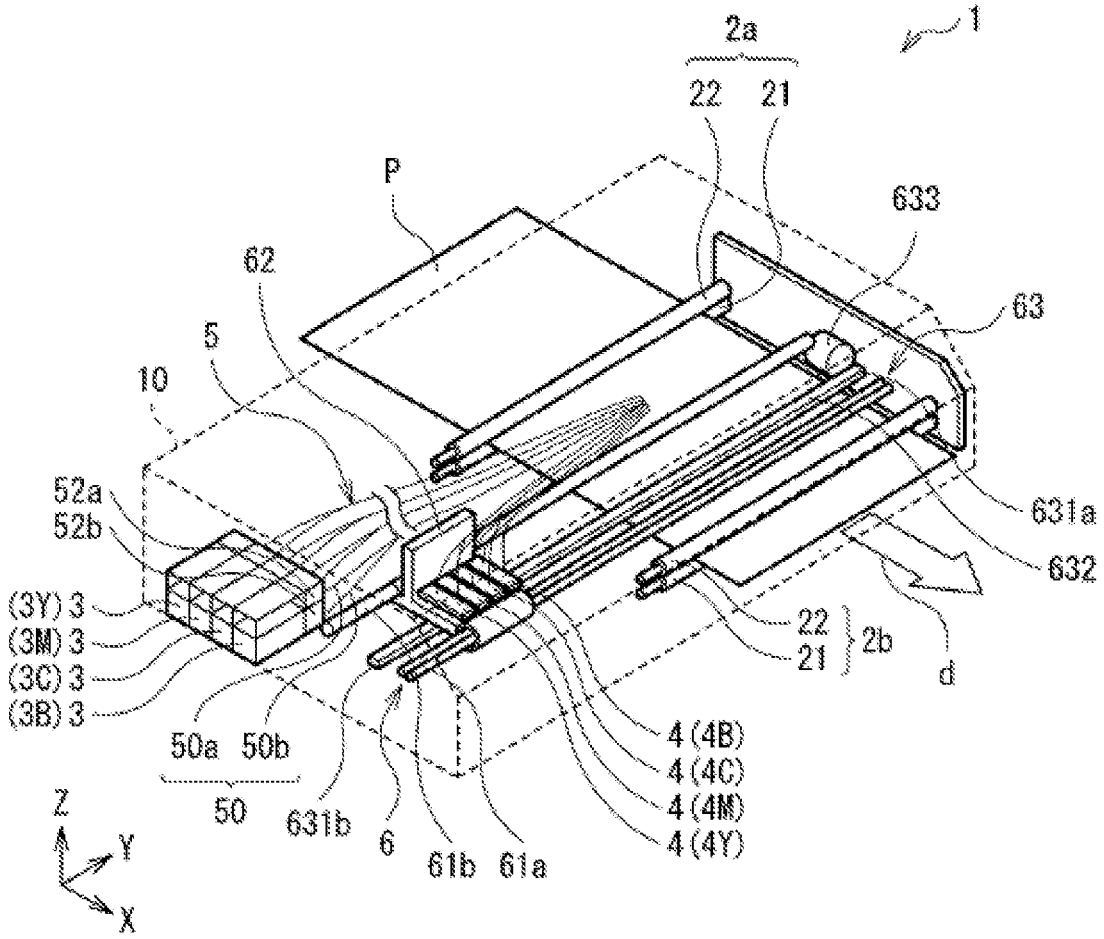
FIG. 1 is a schematic perspective view showing a schematic configuration example of a liquid jet recording device according to an embodiment of the disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and so on, on recording paper P as a recording target medium using ink 9 described later. Although the details will be described later, the printer 1 is also an ink circulation type inkjet printer using the ink 9 being circulated through a predetermined flow channel.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of the "liquid jet head" in the present disclosure. Further, the ink 9 corresponds to a specific example of the "liquid" in the present disclosure. It should be noted that the method for driving a liquid jet head according to an embodiment of the disclosure is embodied in the printer 1 according to the present embodiment, and will therefore be described at the same time. This point also applies to each of the modified examples described later.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1, H2) described later to the recording paper P to thereby perform recording of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction inside the housing 10.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later (FIG. 2 through FIG. 6).

(Circulation Mechanism 5)

The circulation mechanism 5 is a mechanism for circulating the ink 9 between the inside of the ink tanks 3 and the inside of the inkjet heads 4. The circulation mechanism 5 is configured including, for example, circulation channels 50 as flow channels for circulating the ink 9, and pairs of liquid feeding pumps 52*a*, 52*b*.

As shown in FIG. 1, the circulation channels 50 each have a flow channel 50*a* as a part extending from the ink tank 3 to reach the inkjet head 4 via the liquid feeding pump 52*a*, and a flow channel 50*b* as a part extending from the inkjet head 4 to reach the ink tank 3 via the liquid feeding pump 52*b*. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. It should be noted that these flow channels 50*a*, 50*b* (supply tubes of the ink 9) are each formed of a flexible hose having flexibility.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is connected the carriage 62. On the carriage 62, the four types of inkjet heads 4Y, 4M, 4C, and 4B described above are disposed so as to be arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Figure 2:
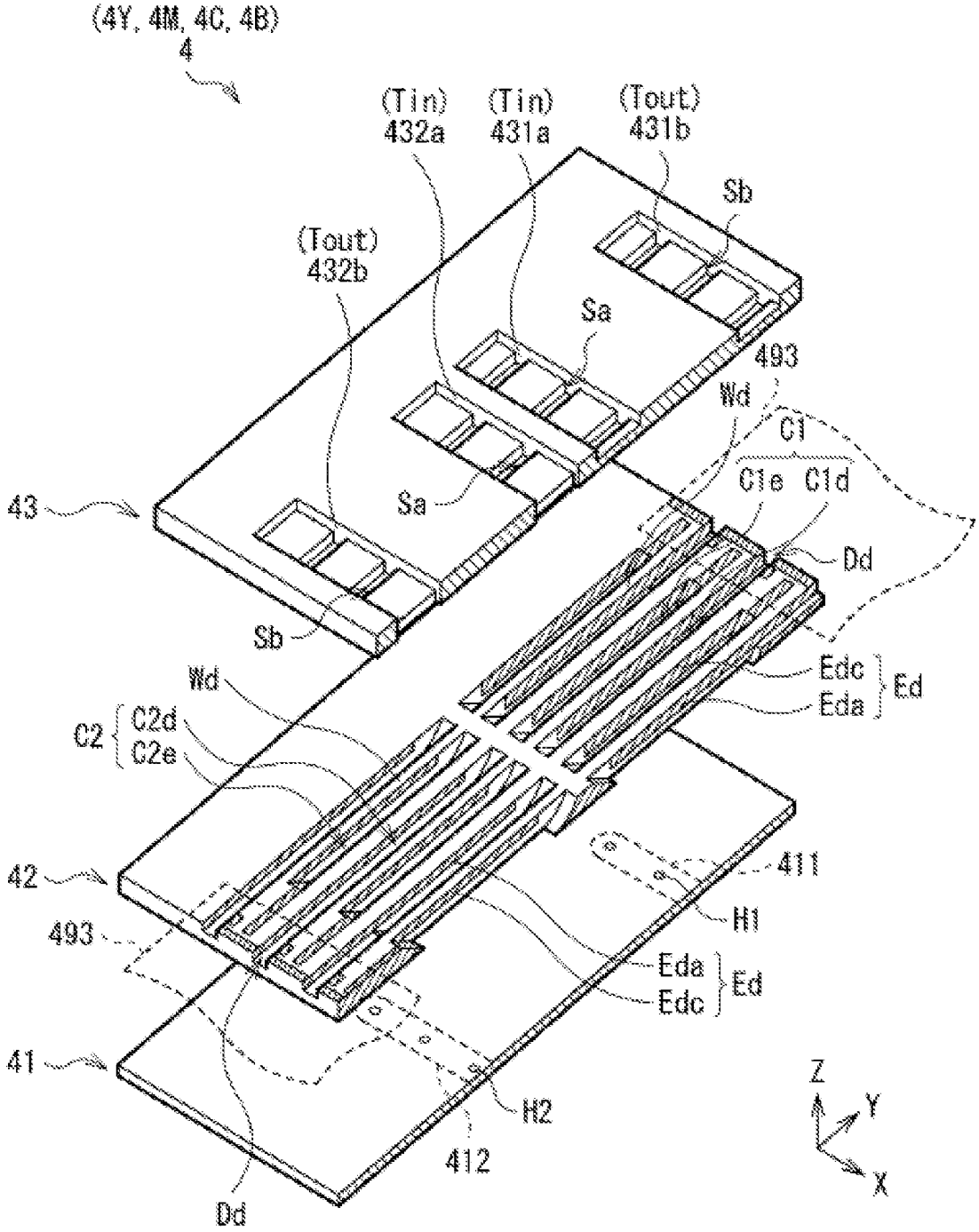
FIG. 2 is an exploded perspective view showing a detailed configuration example of the liquid jet head shown in FIG. 1.
Figure 3:
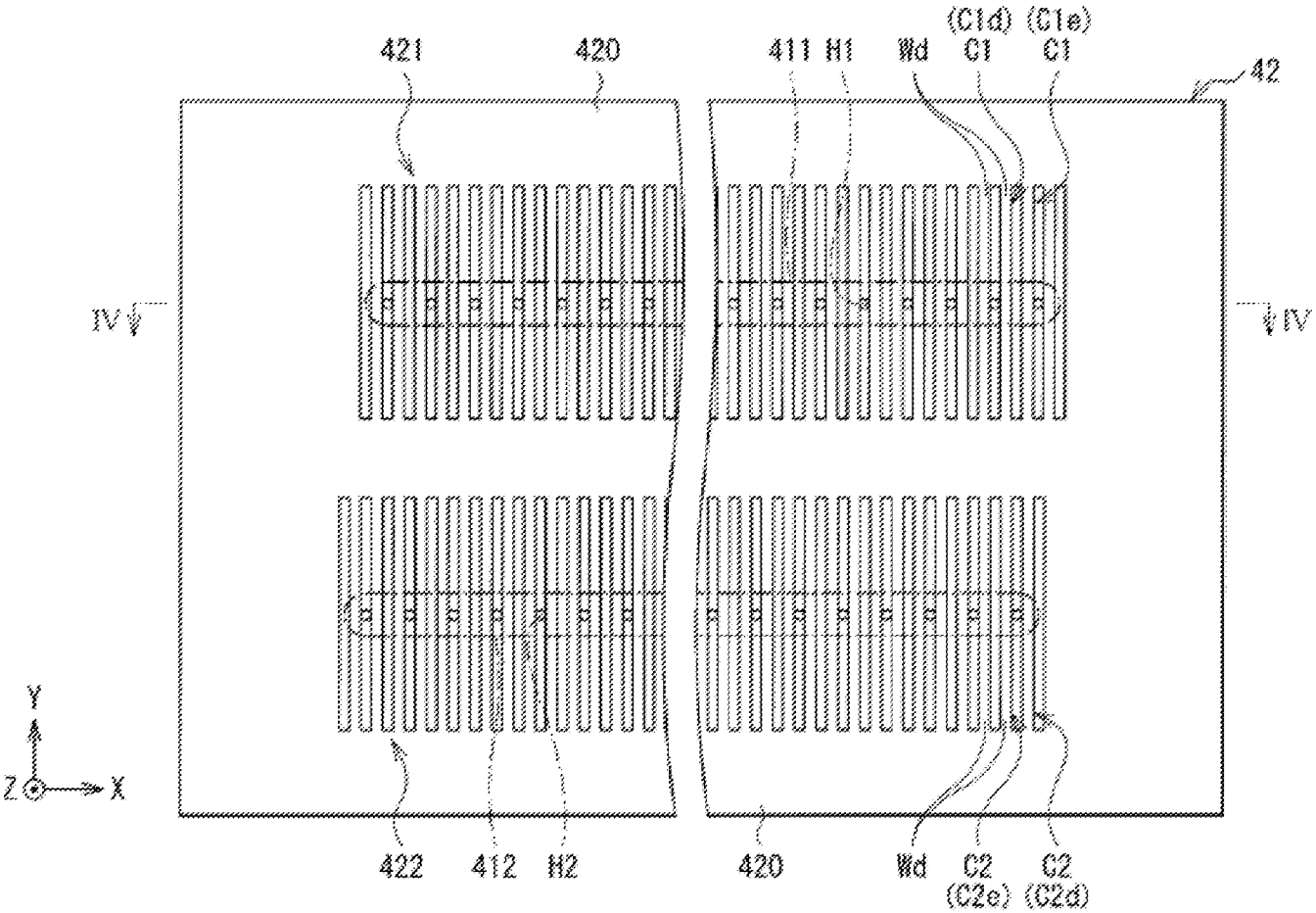
FIG. 3 is a schematic bottom view showing a configuration example of the liquid jet head in the state in which the nozzle plate shown in FIG. 2 is detached.
Figure 4:
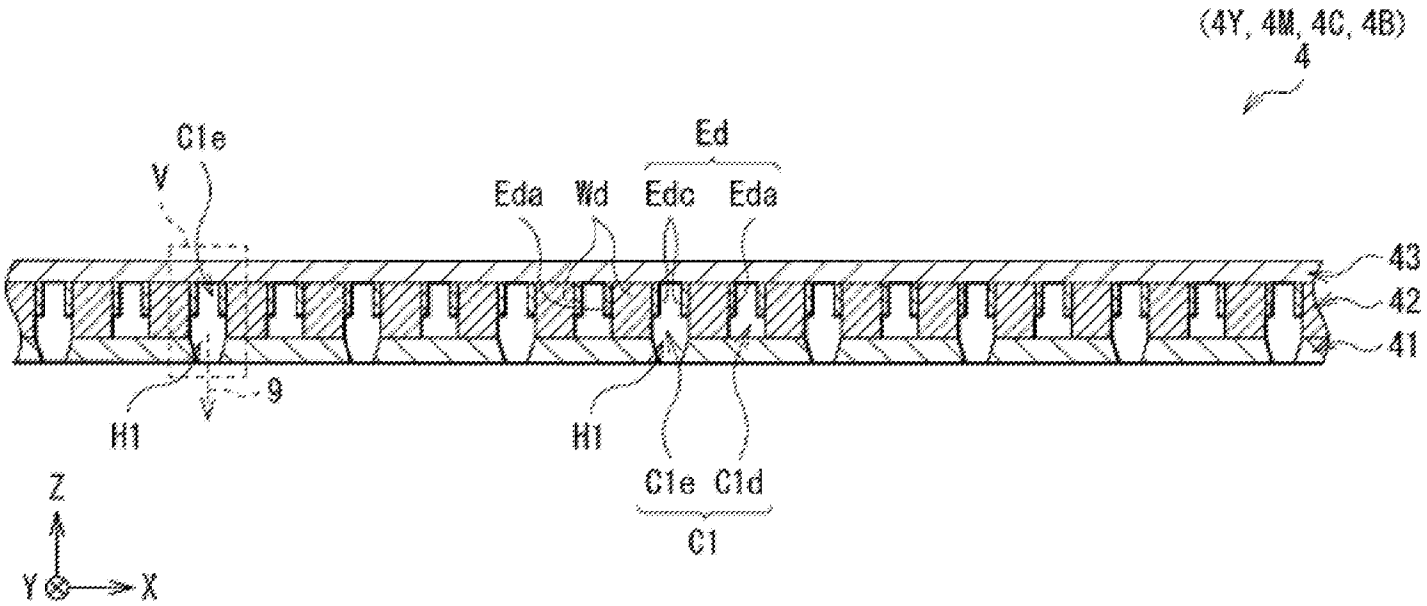
FIG. 4 is a schematic diagram showing a cross-sectional configuration example along the line IV-IV shown in FIG. 3.
Figure 5:
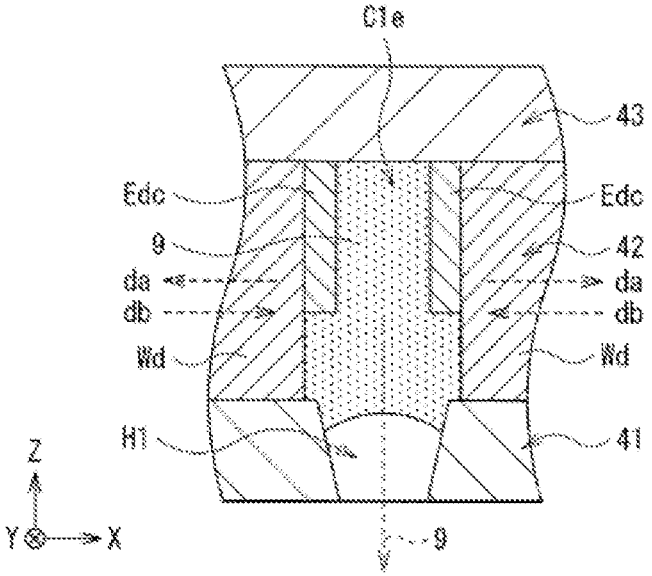
FIG. 5 is a schematic cross-sectional view showing the part V shown in FIG. 4 in an enlarged manner.
Figure 6:
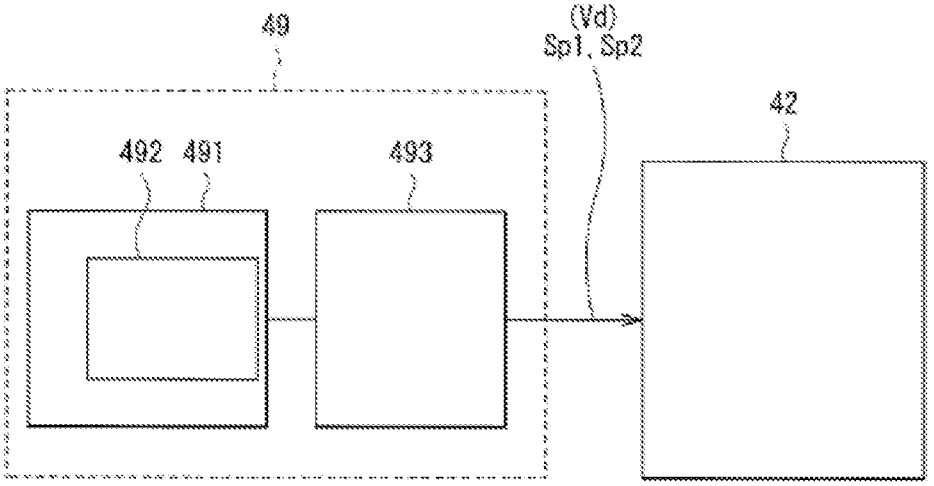
FIG. 6 is a schematic block diagram showing a configuration example of a control section related to the embodiment.

Then, the detailed configuration example of the inkjet heads 4 will be described with reference to FIG. 2 through FIG. 6 in addition to FIG. 1. FIG. 2 is an exploded perspective view showing the detailed configuration example of each of the inkjet heads 4. FIG. 3 is a bottom view (an X-Y bottom view) schematically showing a configuration example of the inkjet head 4 in the state in which the nozzle plate 41 (described later) shown in FIG. 2 is detached. FIG. 4 is a diagram schematically showing a cross-sectional configuration example (a Z-X cross-sectional configuration example) along the line IV-IV shown in FIG. 3. FIG. 5 is a cross-sectional view (a Z-X cross-sectional view) schematically showing the part V shown in FIG. 4 in an enlarged manner. FIG. 6 is a schematic block diagram showing a configuration example of a control section (a control section 49 described later) related to the present embodiment.

The inkjet heads 4 according to the present embodiment are each an inkjet head of a so-called side-shoot type for ejecting the ink 9 from a central part in the extending direction (the Y-axis direction) of each of a plurality of channels (channels C1, C2) described later. Further, the inkjet heads 4 are each an inkjet head of a circulation type which uses the circulation mechanism 5 (the circulation channel 50) described above to thereby use the ink 9 while circulating the ink 9 between the inkjet head 4 and the ink tank 3.

As shown in FIG. 2, the inkjet head 4 is mainly provided with the nozzle plate (a jet hole plate) 41, an actuator plate 42 and a cover plate 43. The nozzle plate 41, the actuator plate 42 and the cover plate 43 are bonded to each other using, for example, an adhesive, and are stacked on one another in this order along the Z-axis direction. It should be noted that the description will hereinafter be presented with the cover plate 43 side along the Z-axis direction referred to as an upper side, and the nozzle plate 41 side referred to as a lower side.

Further, it is also possible to arrange that a flow channel plate (not shown) having a predetermined flow channel is disposed on an upper surface of the cover plate 43. It should be noted that the flow channels 50*a*, 50*b* in the circulation mechanism 5 described above are connected to the flow channel in the flow channel plate so as to achieve inflow of the ink 9 to the flow channel and outflow of the ink 9 from the flow channel, respectively.

(Nozzle Plate 41)

The nozzle plate 41 is formed of a film member made of polyimide or the like having a thickness of, for example, about 50 μm, and is bonded to a lower surface of the actuator plate 42 as shown in FIG. 2. It should be noted that the constituent material of the nozzle plate 41 is not limited to the resin material such as polyimide, but can also be, for example, a metal material. Further, as shown in FIG. 2 and FIG. 3, the nozzle plate 41 is provided with two nozzle columns (nozzle columns 411, 412) each extending along the X-axis direction. These nozzle columns 411, 412 are arranged along the Y-axis direction with a predetermined distance. As described above, the inkjet heads 4 of the present embodiment are each formed as a tow-column type inkjet head.

The nozzle column 411 has a plurality of nozzle holes H1 formed in alignment with each other at predetermined intervals along the X-axis direction. These nozzle holes H1 each penetrate the nozzle plate 41 along the thickness direction (the Z-axis direction) of the nozzle plate 41, and are communicated with the respective ejection channels C1*e* in the actuator plate 42 described later as shown in, for example, FIG. 4 and FIG. 5. Specifically, as shown in FIG. 3, each of the nozzle holes H1 is formed so as to be located in a central part along the Y-axis direction on the ejection channel C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 in such a nozzle column 411.

The nozzle column 412 similarly has a plurality of nozzle holes H2 formed in alignment with each other at predetermined intervals along the X-axis direction. Each of these nozzle holes H2 also penetrates the nozzle plate 41 along the thickness direction of the nozzle plate 41, and is communicated with the ejection channel C2*e* in the actuator plate 42 described later. Specifically, as shown in FIG. 3, each of the nozzle holes H2 is formed so as to be located in a central part along the Y-axis direction on the ejection channel C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 in such a nozzle column 412.

It should be noted that such nozzle holes H1, H2 are each formed as a tapered through hole gradually decreasing in diameter in a direction toward the lower side (see FIG. 4 and FIG. 5), and each correspond to a specific example of a "nozzle" in the present disclosure.

(Actuator Plate 42)

The actuator plate 42 is a plate formed of a piezoelectric material such as lead zirconium titanate (PZT), and is arranged to change the capacity of each of the ejection channels C1*e*, C2*e* although the details will be described later. The actuator plate 42 is formed of, for example, a single (unique) piezoelectric substrate having the polarization direction set one direction along the thickness direction (the Z-axis direction) (a so-called cantilever type). It should be noted that the configuration of the actuator plate 42 is not limited to the cantilever type. Specifically, it is possible to constitute the actuator plate 42 by stacking two piezoelectric substrates different in polarization direction from each other on one another along the thickness direction (the Z-axis direction) (a so-called chevron type). It should be noted that the actuator plate 42 corresponds to a specific example of a "piezoelectric actuator" in the present disclosure.

Further, as shown in FIG. 2 and FIG. 3, the actuator plate 42 is provided with two channel columns (channel columns 421, 422) each extending along the X-axis direction. These channel columns 421, 422 are arranged along the Y-axis direction with a predetermined distance.

In such an actuator plate 42, as shown in FIG. 3, a central part (the formation area of the channel columns 421, 422) along the X-axis direction corresponds to an ejection area (jetting area) of the ink 9. On the other hand, in the actuator plate 42, the both end parts (non-formation areas of the channel columns 421, 422) along the X-axis direction each correspond to a non-ejection area (non-jetting area) of the ink 9. The non-ejection areas are each located on the outer side along the X-axis direction with respect to the ejection area described above. It should be noted that the both end parts along the Y-axis direction in the actuator plate 42 each constitute a tail part 420.

As shown in FIG. 2 and FIG. 3, the channel column 421 described above has the plurality of channels C1 each extending along the Y-axis direction. These channels C1 are arranged side by side so as to be parallel to each other at predetermined intervals along the X-axis direction. As shown in FIG. 4, each of the channels C1 is partitioned with drive walls Wd formed of a piezoelectric body (the actuator plate 42), and forms a groove section having a recessed shape in a cross-sectional view.

As shown in FIG. 2 and FIG. 3, the channel column 422 similarly has the plurality of channels C2 each extending along the Y-axis direction. These channels C2 are arranged side by side so as to be parallel to each other at predetermined intervals along the X-axis direction. Each of the channels C2 is also partitioned with the drive walls Wd described above, and forms a groove section having a recessed shape in the cross-sectional view.

Here, as shown in FIG. 2 through FIG. 4, as the channels C1, there exist the ejection channels C1*e* for ejecting the ink 9 (filled with the ink 9), and dummy channels C1*d* not ejecting the ink 9 (not filled with the ink 9). In the channel column 421, the ejection channels C1*e* and the dummy channels C1*d* are alternately arranged along the X-axis direction. The ejection channels C1*e* are individually communicated with the nozzle holes H1 in the nozzle plate 41 on the one hand, but the dummy channels C1*d* are not communicated with the nozzle holes H1, and are covered with the upper surface of the nozzle plate 41 from below on the other hand (see FIG. 4).

Similarly, as shown in FIG. 2 and FIG. 3, as the channels C2, there exist the ejection channels C2*e* for ejecting the ink 9 (filled with the ink 9), and dummy channels C2*d* not ejecting the ink 9 (not filled with the ink 9). In the channel column 422, the ejection channels C2*e* and the dummy channels C2*d* are alternately arranged along the X-axis direction. The ejection channels C2*e* are individually communicated with the nozzle holes H2 in the nozzle plate 41 on the one hand, but the dummy channels C2*d* are not communicated with the nozzle holes H2, and are covered with the upper surface of the nozzle plate 41 from below on the other hand.

It should be noted that such ejection channels C1*e*, C2*e* each correspond to a specific example of the "ejection chamber" in the present disclosure.

Further, as shown in FIG. 3, the ejection channels C1*e* and the dummy channels C1*d* as the channels C1 and the ejection channels C2*e* and the dummy channels C2*d* as the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. It should be noted that as shown in FIG. 2, in the actuator plate 42, in the part corresponding to each of the dummy channels C1*d*, C2*d*, there is formed a shallow groove section Dd communicated with an outside end part extending along the Y-axis direction in the dummy channel C1*d*, C2*d*.

Here, as shown in FIG. 2, FIG. 4 and FIG. 5, drive electrodes Ed extending along the Y-axis direction are disposed on the inner side surfaces opposed to each other in each of the drive walls Wd described above. As the drive electrodes Ed, there exist common electrodes Edc disposed on the inner side surfaces facing the ejection channels C1*e*, C2*e*, and active electrodes (individual electrodes) Eda disposed on the inner side surfaces facing the dummy channels C1*d*, C2*d*. It should be noted that each of such drive electrodes Ed (the common electrodes Edc and the active electrodes Eda) is not formed beyond an intermediate position in the depth direction (the Z-axis direction) on the inner side surface of the drive wall Wd as shown in FIG. 4 and FIG. 5.

The pair of common electrodes Edc opposed to each other in the same ejection channel C1*e* (or the same ejection channel C2*e*) are electrically connected to each other in a common terminal (not shown). Further, the pair of active electrodes Eda opposed to each other in the same dummy channel C1*d* (or the same dummy channel C2*d*) are electrically separated from each other. In contrast, the pair of active electrodes Eda opposed to each other via the ejection channel C1*e* (or the ejection channel C2*e*) are electrically connected to each other in an active terminal (not shown).

Here, as shown in FIG. 2, in the tail part 420 described above, there is mounted a flexible printed circuit board 493 for electrically connecting the drive electrodes Ed and a control section (the control section 49 described later in the inkjet head 4) to each other. Interconnection patterns (not shown) provided to the flexible printed circuit board 493 are electrically connected to the common terminals and the active terminals described above. Thus, it is arranged that a drive voltage (a drive voltage Vd described later) is applied to each of the drive electrodes Ed from the control section 49 described later via the flexible printed circuit board 493.

(Cover Plate 43)

As shown in FIG. 2, the cover plate 43 is disposed so as to close the channels C1, C2 (the channel columns 421, 422) in the actuator plate 42. Specifically, the cover plate 43 is bonded to the upper surface of the actuator plate 42, and has a plate-like structure.

As shown in FIG. 2, the cover plate 43 is provided with a pair of entrance side common ink chambers 431*a*, 432*a* and a pair of exit side common ink chambers 431*b*, 432*b*. Specifically, the entrance side common ink chamber 431*a* and the exit side common ink chamber 431*b* are formed in respective areas corresponding to the channel column 421 (the plurality of channels C1) in the actuator plate 42. Further, the entrance side common ink chamber 432*a* and the exit side common ink chamber 432*b* are formed in respective areas corresponding to the channel column 422 (the plurality of channels C2) in the actuator plate 42.

The entrance side common ink chamber 431*a* is formed in the vicinity of an inner end part along the Y-axis direction in each of the channels C1, and forms a groove section having a recessed shape (see FIG. 2). In areas corresponding respectively to the ejection channels C1*e* in the entrance side common ink chamber 431*a*, there are respectively formed supply slits Sa penetrating the cover plate 43 along the thickness direction (the Z-axis direction) of the cover plate 43. Similarly, the entrance side common ink chamber 432*a* is formed in the vicinity of an inner end part along the Y-axis direction in each of the channels C2, and forms a groove section having a recessed shape (see FIG. 2). In this entrance side common ink chamber 432*a*, the supply slit Sa described above is also formed in an area corresponding to each of the ejection channels C2*e*. It is arranged that the entrance side common ink chamber 431*a* supplies the ink 9 to the plurality of ejection channels C1*e* adjacent to each other in the channel column 421, and at the same time, the entrance side common ink chamber 432*a* supplies the ink 9 to the plurality of ejection channels C2*e* adjacent to each other in the channel column 422 in such a manner.

It should be noted that these entrance side common ink chambers 431*a*, 432*a* are each formed as a part constituting an entrance part Tin in the inkjet head 4, and each correspond to a specific example of a "common liquid supply chamber" in the present disclosure.

As shown in FIG. 2, the exit side common ink chamber 431*b* is formed in the vicinity of an outer end part along the Y-axis direction in each of the channels C1, and forms a groove section having a recessed shape (see FIG. 2). In areas corresponding respectively to the ejection channels C1*e* in the exit side common ink chamber 431*b*, there are respectively formed discharge slits Sb penetrating the cover plate 43 along the thickness direction of the cover plate 43. Similarly, the exit side common ink chamber 432*b* is formed in the vicinity of an outer end part along the Y-axis direction in the channels C2, and forms a groove section having a recessed shape (see FIG. 2). In this exit side common ink chamber 432*b*, the discharge slit Sb described above is also formed in an area corresponding to each of the ejection channels C2*e*.

It should be noted that these exit side common ink chambers 431*b*. 432*b* each form a part constituting an exit part Tout in the inkjet head 4.

In such a manner, the entrance side common ink chamber 431*a* and the exit side common ink chamber 431*b* are each communicated with the ejection channels C1*e* via the supply slits Sa and the discharge slits Sb, respectively, on the one hand, but are not communicated with the dummy channels C1*d* on the other hand. Specifically, each of the dummy channels C1*d* is arranged to be closed by bottom parts of the entrance side common ink chamber 431*a* and the exit side common ink chamber 431*b* (see FIG. 4).

Similarly, the entrance side common ink chamber 432*a* and the exit side common ink chamber 432*b* are each communicated with the ejection channels C2*e* via the supply slits Sa and the discharge slits Sb, respectively, on the one hand, but are not communicated with the dummy channels C2*d* on the other hand. Specifically, each of the dummy channels C2*d* is arranged to be closed by bottom parts of the entrance side common ink chamber 432*a* and the exit side common ink chamber 432*b*.

(Control Section 49)

Here, each of the inkjet heads 4 according to the present embodiment is also provided with the control section 49 for performing control of a variety of operations in the printer 1 as shown in FIG. 6. The control section 49 is a section for controlling, for example, a recording operation (the jet operation of the ink 9 in the inkjet head 4) of images, characters and so on in the printer 1.

Specifically, as shown in FIG. 6, the control section 49 is arranged to apply the drive voltage Vd described above to each of the drive electrodes Ed in the actuator plate 42 via the flexible printed circuit board 493 to thereby control such a jet operation of the ink 9. In other words, the control section 49 is arranged to apply one pulse signal or a plurality of pulse signals pulse signals Sp1, Sp2 described later in this example) to the actuator plate 42. Thus, the drive walls Wd described above in the actuator plate 42 deform to expand or contract the capacity of each of the ejection channels C1*e*, C2*e* described above to thereby jet the ink 9 filling each of the ejection channels C1*e*, C2*e* via the nozzle H1, H2 although the details will be described later.

As shown in FIG. 6, such a control section 49 has an IC (integrated circuit) board 491 on which the control circuit 492 and so on are mounted, and the flexible printed circuit board 493 described above. As described above, the control circuit 492 is a circuit for applying the drive voltage Vd (the pulse signals Sp1, Sp2) to each of the drive electrodes Ed (between the common electrode Edc and the active electrode Eda described above) in the actuator plate 42.

It should be noted that the details of the control operation by the control section 49 will be described later (FIG. 7 through FIG. 11B and so on).

Operations and Functions/Advantages

A. Basic Operation of Printer 1

In the printer 1, the recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* each rotate to thereby carry the recording paper P along the carrying direction d (the X-axis direction) between the grit rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

B. Detailed Operation in Inkjet Heads 4

Then, the detailed operation (the jet operation of the ink 9) in the inkjet head 4 will be described with reference to FIG. 1 through FIG. 6. Specifically, in the inkjet heads 4 (the side-shoot type) according to the present embodiment, the jet operation of the ink 9 using a shear mode is performed in the following manner.

Firstly, when the reciprocation of the carriage 62 (see FIG. 1) described above is started, the control section 49 applies the drive voltages Vd to the drive electrodes Ed (the common electrodes Edc and the active electrodes Eda) in the inkjet head 4 via the flexible printed circuit board 493. Specifically, the control section 49 applies the drive voltage Vd to the drive electrodes Ed disposed on the pair of drive walls Wd forming the ejection channel C1*e*, C2*e*. Thus, the pair of drive walls Wd each deform (see FIG. 4) so as to protrude toward the dummy channel C1*d*, C2*d* adjacent to the ejection channel C1*e*, C2*e*.

Here, as described above, in the actuator plate 42, the polarization direction is set to the one direction, and at the same time, the drive electrodes Ed are not formed beyond the intermediate position in the depth direction on the inner side surfaces in the drive walls Wd. Therefore, application of the drive voltage Vd using the control section 49 results in a flexion deformation of the drive wall Wd having a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges (see the expansion directions da shown in FIG. 5).

Incidentally, in the case in which the configuration of the actuator plate 42 is not the cantilever type but is the chevron type described above, the drive wall Wd makes the flexion deformation to have the V shape in the following manner. Specifically, in the case of the chevron type, the polarization direction of the actuator plate 42 differs along the thickness direction (the two piezoelectric substrates described above are stacked on one another), and at the same time, the drive electrodes Ed are formed in the entire area in the depth direction on the inner side surface in each of the drive walls Wd. Therefore, application of the drive voltage Vd using the control section 49 described above results in a flexion deformation of the drive wall Wd having a V shape centered on the intermediate position in the depth direction in the drive wall Wd. As a result, also in this case, due to such a flexion deformation of the drive wall Wd, the ejection channel C1*e*, C2*e* deforms as if the ejection channel C1*e*, C2*e* bulges (see the expansion directions da shown in FIG. 5).

As described above, due to the flexion deformation caused by a piezoelectric thickness-shear effect in the pair of drive walls Wd, the capacity of the ejection channel C1*e*, C2*e* increases. Further, due to the increase of the capacity of the ejection channel C1*e*, C2*e*, it results in that the ink 9 retained in the entrance side common ink chamber 431*a*, 432*a* is induced into the ejection channel C1*e*, C2*e* (see FIG. 2).

Subsequently, the ink 9 having been induced into the ejection channel C1*e*, C2*e* in such a manner turns to a pressure wave to propagate to the inside of the ejection channel C1*e*, C2*e*. Then, the drive voltage Vd to be applied to the drive electrodes Ed becomes 0 (zero) V at the timing at which the pressure wave has reached the nozzle hole H1, H2 of the nozzle plate 41. Thus, the drive walls Wd are restored from the state of the flexion deformation described above, and as a result, the capacity of the ejection channel C1*e*, C2*e* having once increased is restored again (see the contraction directions db shown in FIG. 5).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 4 and FIG. 5) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed.

In particular, the nozzle holes H1, H2 of the present embodiment each have the tapered shape gradually decreasing in diameter in the downward direction (see FIG. 4 and FIG. 5) as described above, and can therefore eject the ink 9 straight (good in straightness) at high speed. Therefore, it becomes possible to perform recording high in image quality.

C. Circulation Operation of Ink 9

Then, the circulation operation of the ink 9 by the circulation mechanism 5 will be described in detail with reference to FIG. 1, FIG. 2, FIG. 4 and FIG. 5.

As shown in FIG. 1, in the printer 1, the ink 9 is fed by the liquid feeding pump 52*a* from the inside of the ink tank 3 to the inside of the flow channel 50*a*. Further, the ink 9 flowing through the flow channel 50*b* is fed by the liquid feeding pump 52*b* to the inside of the ink tank 3.

On this occasion, in the inkjet head 4, the ink 9 flowing from the inside of the ink tank 3 via the flow channel 50*a* inflows into the entrance side common ink chambers 431*a*, 432*a* (the entrance parts Tin) (see FIG. 1 and FIG. 2). The ink 9 having been supplied to these entrance side common ink chambers 431*a*, 432*a* is supplied to the ejection channels C1*e*, C2*e* in the actuator plate 42, respectively, via the supply slits Sa (see FIG. 2, FIG. 4 and FIG. 5).

Further, the ink 9 in the ejection channels C1*e*, C2*e* flows into the exit side common ink chamber 431*b*, 432*b* (the exit part Tout) via the discharge slits Sb (see FIG. 2). The ink 9 supplied to these exit side common ink chambers 431*b*, 432*b* inflows from the inside of the inkjet head 4 into the flow channel 50*b* (see FIG. 1 and FIG. 2). Then, the ink 9 having been discharged to the flow channel 50*b* is returned to the inside of the ink tank 3 as a result. In such a manner, the circulation operation of the ink 9 by the circulation mechanism 5 is achieved.

Here, in the inkjet head of a type other than the circulation type, in the case of using fast drying ink, there is a possibility that a local increase in viscosity or local solidification of the ink occurs due to drying of the ink in the vicinity of the nozzle hole, and as a result, a failure such as an ink ejection failure occurs. In contrast, in the inkjet heads 4 (the circulation type inkjet heads) according to the present embodiment, since the fresh ink 9 is always supplied to the vicinity of the nozzle holes H1, H2, the failure such as the failure in ejection of the ink described above is prevented as a result.

D. Control Operation by Control Section 49

Here, a control operation example by the control section 49 described above will be described in detail with reference to FIG. 7 through FIG. 11B in addition to FIG. 1 through FIG. 6.

D-1. Setting of Grouping in Ejection Channels C1*e*, C2*e*

Figure 7:
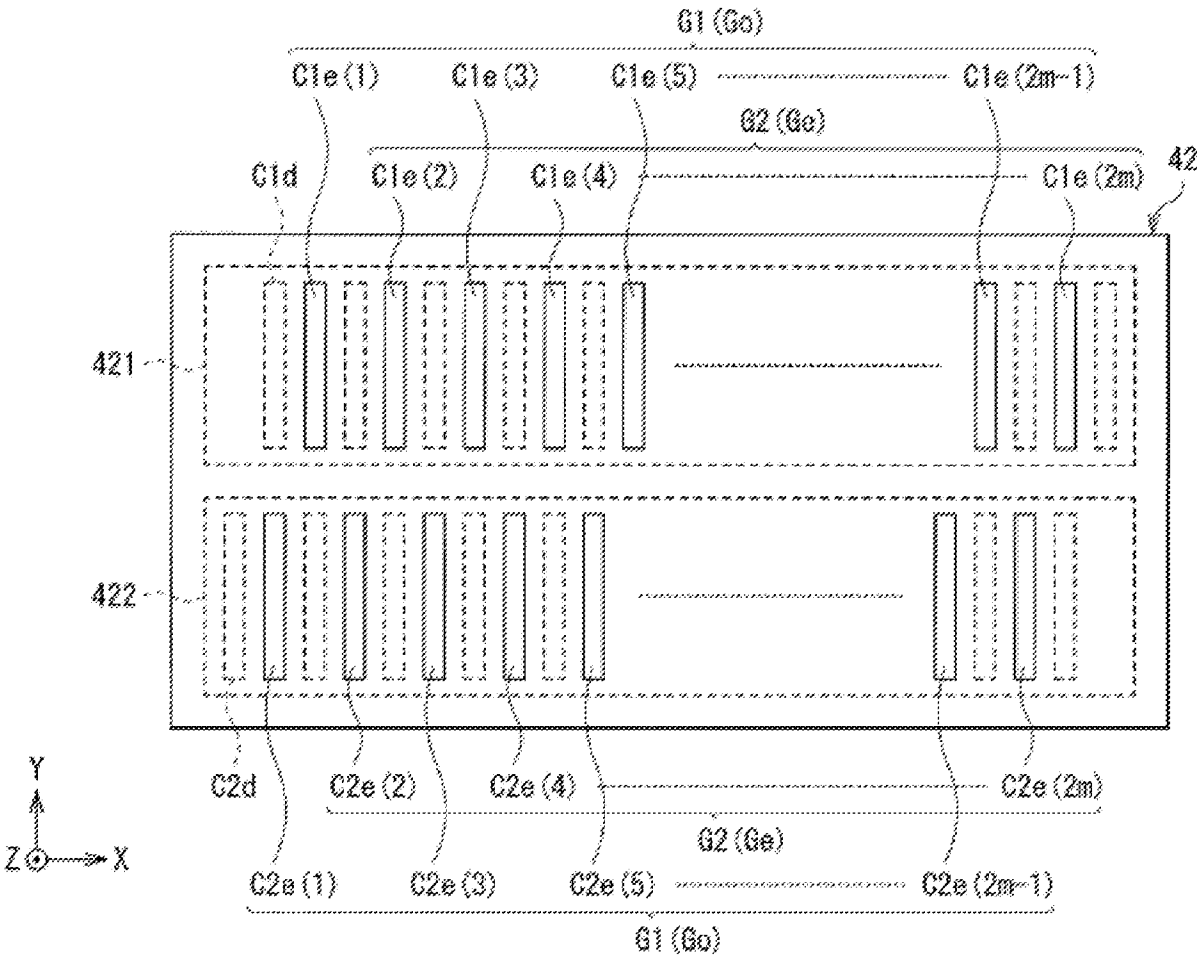
FIG. 7 is a schematic plan view showing a configuration example of grouping of pressure chambers related to the embodiment.

FIG. 7 is a plan view (an X-Y plan view) schematically showing a configuration example of grouping of the ejection channels C1*e*, C2*e* related to the present embodiment.

Firstly, when performing the control operation related to the present embodiment, there is provided a configuration in which the ejection channels C1*e* (C2*e*) adjacent to each other out of the plurality of ejection channels C1*e* (C2*e*) in the actuator plate 42 respectively belong to a plurality of groups different from each other. Specifically, in the present embodiment, as shown in FIG. 7, the plurality of ejection channels C1*e* arranged side by side along the channel column 421 and the plurality of ejection channels C2*e* arranged side by side along the channel column 422 are each grouped into two groups G1, G2.

The ejection channels C1*e*, C2*e* arranged at odd-numbered (1-st, 3-rd, 5-th, . . . ) places starting from one end part along the X-axis direction in the respective channel columns 421, 422 are arranged to belong to the group G1. Specifically, as shown in FIG. 7, the 1-st ejection channels C1*e*(1), C2*e*(1), the 3-rd ejection channels C1*e*(3), C2*e*(3), the 5-th ejection channels C1*e*(5), C2*e*(5), . . . , and the (2m−1)-th (m is a positive integer) ejection channels C1*e*(2m−1), C2*e* (2m−1) belong to the group G1.

In contrast, the ejection channels C1*e*, C2*e* arranged at even-numbered (2-nd, 4-th, 6-th, . . . ) places starting from the one end part along the X-axis direction in the respective channel columns 421, 422 are arranged to belong to the group G2. Specifically, as shown in FIG. 7, the 2-nd ejection channels C1*e*(2), C2*e*(2), the 4-th ejection channels C1*e*(4), C2*e*(4), the 6-th ejection channels C1*e*(6), C2*e*(6), . . . , and the (2m)-th ejection channels C1*e*(2m), C2*e*(2m) belong to the group G2.

As described above, it is arranged that the group G1 functions as an odd group Go, and at the same time, the group G2 functions as an even group Ge as described in combination in the parentheses in FIG. 7 and so on. In other words, it is arranged that the ejection channels C1*e* (C2*e*) belonging to one of the two groups G1 (Go), G2 (Ge) and the ejection channels C1*e* (C2*e*) belonging to the other of the two groups G1 (Go), G2 (Ge) are alternately arranged along the X-axis direction.

D-2. Setting of Shift Amount Δtd Between Groups G1, G2

Further, in the control operation of the present embodiment, the control section 49 is arranged to set the shift amount Δtd in timing between such groups G1, G2. Specifically, as described hereinafter in detail, the control section 49 sets such a shift amount Δtd between the pulse signal Sp1 applied to the ejection channels C1*e*, C2*e* belonging to the group G1 and the pulse signal Sp2 applied to the ejection channels C1*e*, C2*e* belonging to the group G2. In other words, in the control operation of the present embodiment, unlike a control operation related to a comparative example (see FIG. 12) described later, it is arranged that the timings of the pulse signals Sp1, Sp2 to be applied are not concurrent and made different from each other between the ejection channels C1*e* (C2*e*) belonging respectively to the two groups G1, G2.

Figures 8A, 8B, 8C:
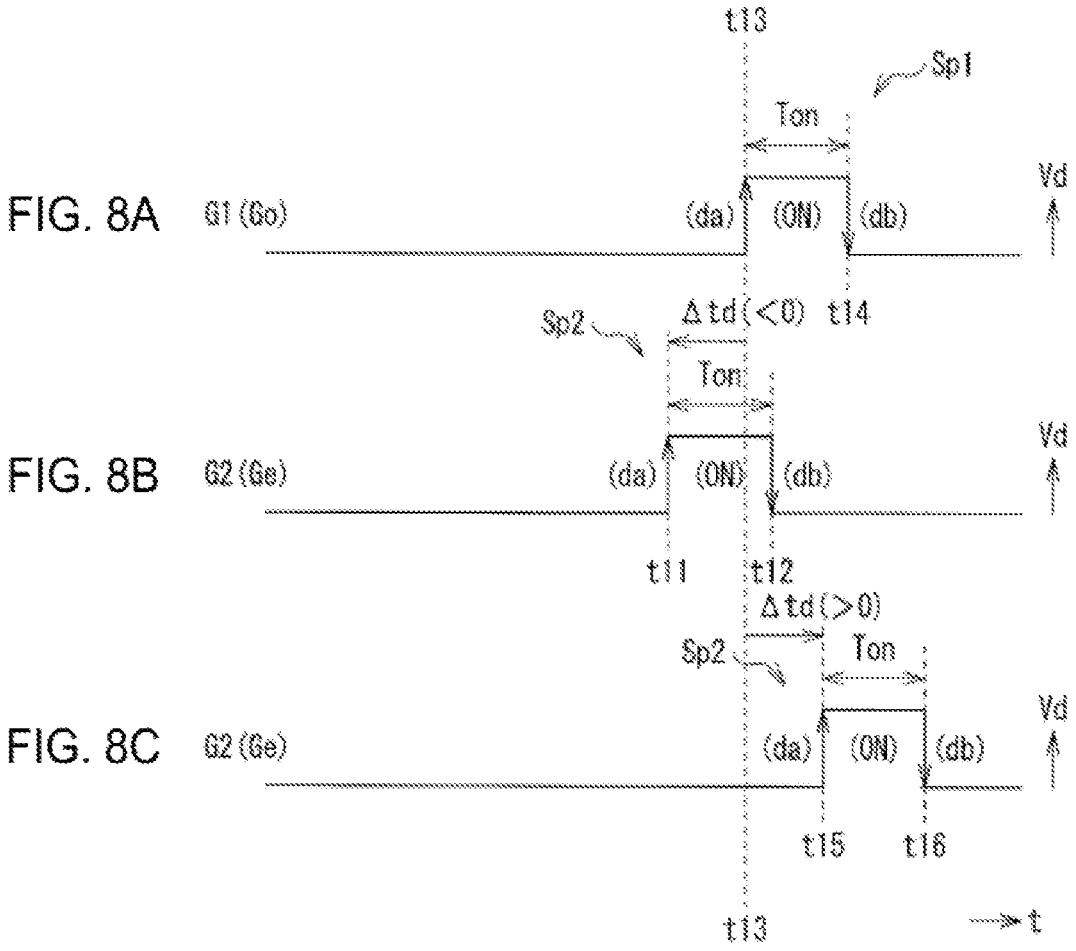
FIGS. 8A through 8C are schematic waveform charts showing an example of a shift amount between pulse signals of the respective groups related to the embodiment.

Here, FIGS. 8A through 8D and FIGS. 9A through 9D are each a waveform chart schematically showing an example of the shift amount Δtd of each of the pulse signals Sp1, Sp2 between the two groups G1, G2 described above, wherein the horizontal axis represents time t, and the vertical axis represents the drive voltage Vd (a positive voltage in the present example). Specifically, FIGS. 8A through 8C show an example of the case in which the shift amount Δtd is defined between the rising timing of the pulse signal Sp1 in the group G1 (Go) and the rising timing of the pulse signal Sp2 in the group G2 (Ge). In contrast, FIGS. 9A through 9C show an example of the case in which the shift amount Δtd is defined between the falling timing of the pulse signal Sp1 in the group G1 (Go) and the falling timing of the pulse signal Sp2 in the group G2 (Ge).

It should be noted that the pulse signals Sp1, Sp2 shown in FIGS. 8A through 8C and FIGS. 9A through 9C each have an ON period Ton (the pulse width of "ON") between the rising timing and the falling timing. Further, these pulse signals Sp1, Sp2 are each a pulse signal (a positive pulse signal) for expanding the ejection channel C1*e*, C2*e* (see the expansion directions da in the parentheses) in the period of the high state, and at the same time, contracting the ejection channel C1*e*, C2*e* (see the contraction directions db in the parentheses) in the period of the low state.

Firstly, in the example shown in FIGS. 8A through 8D, the control section 49 sets a predetermined shift amount Δtd between the rising timing of the pulse signal Sp1 in the group G1 (Go) and the rising timing of the pulse signal Sp2 in the group G2 (Ge). In other words, the control section 49 makes the pulse signals Sp1, Sp2 different in timing from each other between the two groups G1 (Go), G2 (Ge), and at the same time, sets such a shift amount Δtd between the rising timings in these pulse signals Sp1, Sp2.

Specifically, the pulse signal Sp1 of the group G1 (Go) shown in FIG. 8A is made as a pulse signal rising at the timing t13 and then falling at the timing t14. In contrast, an example of the pulse signal Sp2 of the group G2 (Ge) shown in FIG. 8B is made as a pulse signal rising at the timing t11 and then falling at the timing t12. Similarly, an example of the pulse signal Sp2 of the group G2 (Ge) shown in FIG. 8C is made as a pulse signal rising at the timing t15 and then falling at the timing t16.

Further, in the example of the case in which the pulse signals Sp1, Sp2 shown in FIG. 8A and FIG. 8B are combined with each other, the shift amount Δtd (the shift amount to the timing t11 based on the timing t13 in this example) described above takes a negative value (Δtd<0). In contrast, in the example of the case in which the pulse signals Sp1, Sp2 shown in FIG. 8A and FIG. 8C are combined with each other, the shift amount Δtd (the shift amount to the timing t15 based on the timing t13 in this example) described above takes a positive value (Δtd>0).

Further, in the example shown in FIGS. 9A through 9C, the control section 49 sets a predetermined shift amount Δtd between the falling timing of the pulse signal Sp1 in the group G1 (Go) and the falling timing of the pulse signal Sp2 in the group G2 (Ge). In other words, the control section 49 makes the pulse signals Sp1, Sp2 different in timing from each other between the two groups G1 (Go), G2 (Ge), and at the same time, sets such a shift amount Δtd between the falling timings in these pulse signals Sp1, Sp2.

Specifically, the pulse signal Sp1 of the group G1 (Go) shown in FIG. 9A is made as a pulse signal rising at the timing t11 and then falling at the timing t13. In contrast, an example of the pulse signal Sp2 of the group G2 (Ge) shown in FIG. 9B is made as a pulse signal rising at the timing t12 and then falling at the timing t14. Similarly, an example of the pulse signal Sp2 of the group G2 (Ge) shown in FIG. 9C is made as a pulse signal rising at the timing t15 and then falling at the timing t16.

Further, in the example of the case in which the pulse signals Sp1, Sp2 shown in FIG. 9A and FIG. 9B are combined with each other, the shift amount Δtd (the shift amount to the timing t14 based on the timing t13 in this example) described above takes a negative value (Δtd<0). In contrast, in the example of the case in which the pulse signals Sp1, Sp2 shown in FIG. 9A and FIG. 9C are combined with each other, the shift amount Δtd (the shift amount to the timing t16 based on the timing t13 in this example) described above takes a positive value (Δtd>0).

D-3. Regarding Value of Shift Amount ΔTd

Here, FIGS. 10A through 10C are diagrams schematically showing a setting example of the value of the shift amounts Δtd shown in FIGS. 8A through 8C and FIGS. 9A through 9C.

Firstly, in the example shown in FIG. 10A, the control section 49 sets the shift amount Δtd (the absolute value |Δtd| of the shift amount Δtd) described above so as to approximate an integral multiple of the on-pulse peak (AP) (|Δtd|=(n×AP), (n: an integer)). Specifically, the control section 49 sets the absolute value |Δtd| of the shift amount Δtd so as to approximate any one of, for example, (1×AP), (2×AP), (3×AP), (4×AP), . . . .

Here, the AP corresponds to a period (1 AP=(characteristic vibration period of the ink 9)/2) half as large as the characteristic vibration period of the ink 9 in the ejection channel C1*e*, C2*e*, and it is arranged that the jetting speed of the ink 9 is maximized when ejecting (a droplet of) the ink 9 as much as one normal droplet. Further, the AP is arranged to be defined by, for example, the shape of the ejection channel C1*e*, C2*e* and the specific gravity of the ink 9.

In contrast, in the example shown in FIG. 10B, the control section 49 sets the shift amount Δtd (the absolute value |Δtd| of the shift amount Δtd) so as to be an integral multiple of the AP described above (|Δtd|=(n×AP), (n: an integer)). Specifically, the control section 49 sets the absolute value |Δtd| of the shift amount Δtd so as to be any one of, for example, (1×AP), (2×AP), (3×AP), (4×AP), . . . .

Further, in the example shown in FIG. 10C, the control section 49 sets the shift amount Δtd (the absolute value |Δtd| of the shift amount Δtd) so as to be equal to the AP described above (|Δtd|=(1×AP)). In other words, the control section 49 sets the absolute value |Δtd| of the shift amount Δtd so as to be equal to (1×AP).

D-4. Regarding Path for Obtaining Information I(ΔTd) Related to Shift Amount ΔTd Here, FIG. 11A and FIG. 11B are each a schematic block diagram (see FIG. 6 described above) showing an example of the path for obtaining the information I(Δtd) related to such a shift amount Δtd.

Figure 11A:
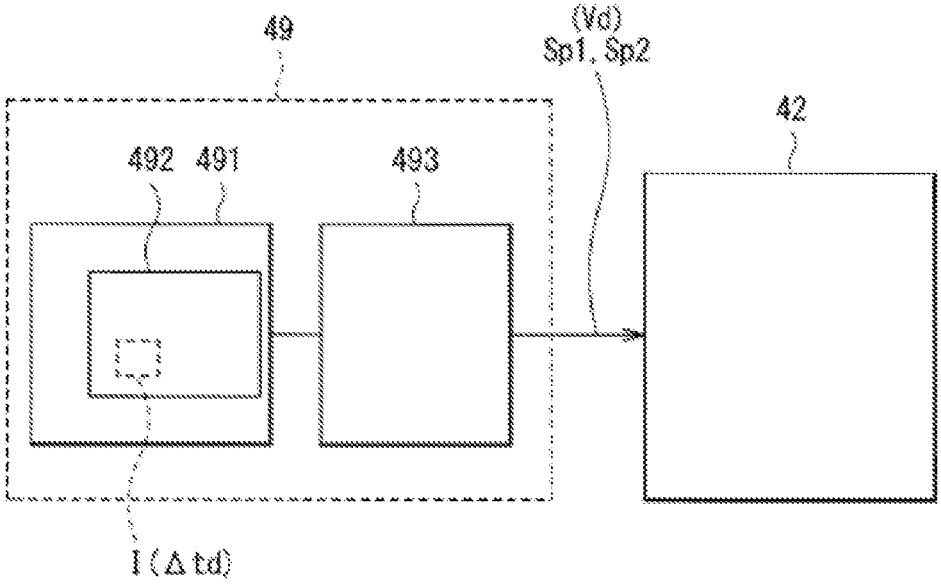
FIGS. 11A and 11B are schematic block diagrams showing an example of a path for obtaining the information related to the shift amount.

Firstly, in the example shown in FIG. 11A, the control section 49 stores in advance the information I(Δtd) related to the shift amount Δtd in, for example, the control circuit 492 (e.g., a predetermined memory). Further, the control section 49 is arranged to generate each of the pulse signals Sp1, Sp2 having the shift amount Δtd shown in, for example, FIG. 8A through FIG. 10C based on the information I(Δtd) related to the shift amount Δtd stored in such a manner.

Figure 11B:
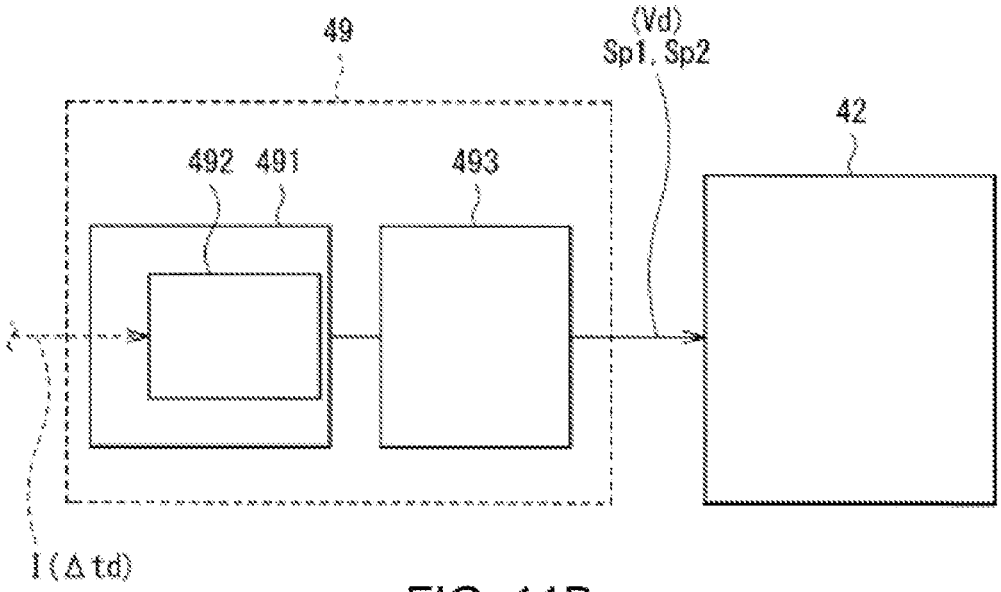

In contrast, in the example shown in FIG. 11B, the control section 49 obtains the information I(Δtd) related to the shift amount Δtd from the outside of the inkjet head 4. Further, the control section 49 is arranged to generate each of the pulse signals Sp1, Sp2 having the shift amount Δtd shown in, for example, FIG. 8A through FIG. 10C based on the information I(Δtd) related to the shift amount Δtd obtained from the outside of the inkjet head 4 in such a manner.

E. Functions/Advantages

Then, the functions and the advantages in the inkjet head 4 and the printer 1 according to the present embodiment will be described in detail in comparison with a comparative example (see FIG. 12).

E-1. Comparative Example

Figure 12:
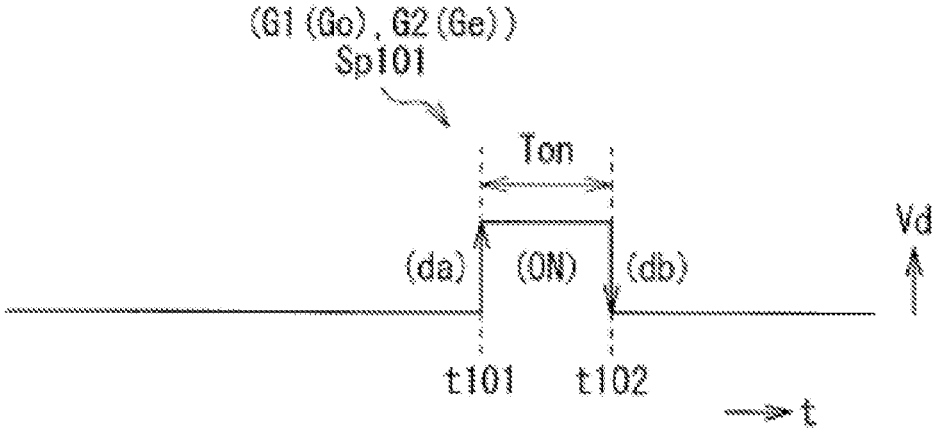
FIG. 12 is a schematic waveform chart showing a pulse signal related to a comparative example.

FIG. 12 is a waveform chart schematically showing a pulse signal Sp101 related to the comparative example, wherein the horizontal axis represents time t, and the vertical axis represents the drive voltage Vd (a positive voltage in this example).

As shown in FIG. 12, in the control operation related to this comparative example, unlike the control operation of the present embodiment shown in FIGS. 8A through 8C and FIGS. 9A through 9C, the pulse signal Sp101 concurrent and is applied to all of the ejection channels C1*e*, C2*e* in the actuator plate 42. In other words, as indicated by the description in the parentheses in FIG. 12, in the control operation of the comparative example, it results in that the pulse signal Sp101 thus concurrent is also applied to the ejection channels C1*e*, C2*e* belonging to the two groups G1, G2 described above, for example.

In the case of using the control operation of such a comparative example, since it results in that the expansion timing and the contraction timing are each common to (coincide in) all of the ejection channels C1*e*, C2*e* in the actuator plate 42, there is a possibility that such a problem as described below, for example, arises. Specifically, there is a possibility that instantaneous flow in one direction or the like of the ink 9 occurs in the plurality of ejection channels (the ejection channels C1*e*, or the ejection channels C2*e*) adjacent to each other in, for example, the channel column 421, 422, and thus, crosstalk (mutual interference) between the plurality of ejection channels adjacent to each other occurs. Such crosstalk occurs due to the influence on the plurality of ejection channels exerted by repercussions caused by the capacity variation in the ejection channels C1*e*, C2*e* and propagating via the ink 9 in the ejection channels C1*e*, C2*e*. Further, if such crosstalk occurs, there is a possibility that the variation in the jetting speed of the ink 9, the variation in droplet size of the ink 9 and so on increase between the corresponding nozzles (the nozzle holes H1 or the nozzle holes H2) to degrade the printed image quality.

Incidentally, for example, it is also possible to adopt a method of, for example, reading the printing result to the recording paper P on the printer side, and at the same time, optimizing the drive condition for each of the nozzles in accordance with the reading result, but in such a method, the following problem can arise. That is, there arises a necessity of mounting the reading mechanism of the printing result on the printer, and it becomes necessary to perform cumbersome control of optimizing the drive condition for each of the nozzles on a case-by-case basis.

E-2. Present Embodiment

In contrast, in the inkjet head 4 and the printer 1 according to the present embodiment, the control operation by the control section 49 is performed in such a manner as described below.

That is, firstly, as shown in FIG. 7 described above, there is provided the configuration in which the ejection channels C1*e* (C2*e*) adjacent to each other out of the plurality of ejection channels C1*e* (C2*e*) in the actuator plate 42 respectively belong to the plurality of groups different from each other. Specifically, in the present embodiment, the plurality of ejection channels C1*e* arranged side by side along the channel column 421 and the plurality of ejection channels C2*e* arranged side by side along the channel column 422 are each grouped into the two groups G1, G2.

Further, unlike the comparative example described above, the control section 49 does not make the timings of the pulse signals Sp1, Sp2 to be concurrently applied, but makes the timings of the pulse signals Sp1, Sp2 to be applied different from each other between the ejection channels C1*e* (C2*e*) belonging respectively to such two groups G1, G2. Specifically, as shown in, for example, FIGS. 8A through 8C and FIGS. 9A through 9C, the control section 49 makes the pulse signals Sp1, Sp2 different in timing from each other between the two groups G1 (Go), G2 (Ge), and at the same time, sets such a predetermined shift amount Δtd between these pulse signals Sp1, Sp2.

More specifically, as shown in FIGS. 8A through 8C, for example, the control section 49 sets such a shift amount Δtd between the rising timing of the pulse signal Sp1 in the group G1 and the rising timing of the pulse signal Sp2 in the group G2. Alternatively, as shown in FIGS. 9A through 9C, for example, the control section 49 sets such a shift amount Δtd between the falling timing of the pulse signal Sp1 in the group G1 and the falling timing of the pulse signal Sp2 in the group G2.

Then, as shown in, for example, FIG. 10A, the control section 49 sets such a shift amount Δtd (the absolute value |Δtd| of the shift amount Δtd) so as to approximate an integral multiple of the on-pulse peak (AP) described above (|Δtd|≈(n×AP), (n: an integer)).

By performing such a control operation, the following occurs in the present embodiment compared to the comparative example described above. That is, since the shift amount Δtd described above is set so as to approximate the integral multiple of the AP in the groups G1, G2 different from each other when jetting the ink 9, it results in that the timing of the expansion and the timing of the contraction of the ejection channels C1*e*, C2*e* are appropriately adjusted between the groups G1, G2 (see the expansion directions da and the contraction directions db in the parentheses shown in FIGS. 8A through 8C and FIGS. 9A through 9C).

Here, the repercussions (described above) propagating to the plurality of ejection channels C1*e*, C2*e* adjacent to each other out of the plurality of ejection channels C1*e*, C2*e* vary in phase at the wavelength of the AP similarly to each of the ejection channels C1*e*, C2*e*. Therefore, by setting the shift amount Δtd so as to approximate the integral multiple of the AP between the plurality of groups G1, G2, it results in that the phase of the repercussions propagating approximates the reversal timing, and thus, the influence of the crosstalk is reduced.

Further, in a different point of view, such a reduction action of the crosstalk can also be said that local scrambling for the ink 9 to the ejection channels C1*e* (C2*e*) between the plurality of groups G1, G2 is suppressed by setting the shift amount Δtd.

In such a manner, the instantaneous flow in one direction or the like of the ink 9 is suppressed in the plurality of ejection channels (the ejection channels C1*e*, or the ejection channels C2*e*) adjacent to each other, and thus, occurrence of the crosstalk between the plurality of ejection channels adjacent to each other is reduced in the present embodiment compared to the comparative example described above. As a result, the variation in the jetting speed of the ink 9, the variation in droplet size of the ink 9 and so on are suppressed between the corresponding nozzles (the nozzle holes H1 or the nozzle holes H2).

Due to the above, in the present embodiment, it becomes possible to improve the printed image quality compared to the comparative example described above. Further, since the structure itself of the inkjet head 4 is not required to be changed from the existing structure, and it is sufficient to change only the control operation by the control section 49 (the waveforms of the pulse signals), it becomes possible to obtain such an improvement effect of the printed image quality while keeping the structure of the existing inkjet head.

Further, in the present embodiment, as shown in, for example, FIG. 10B, in the case in which the control section 49 sets the shift amount Δtd (the absolute value |Δtd| of the shift amount Δtd) so as to be an integral multiple of the AP (|Δtd|=(n×AP), (n: an integer)), the following occurs. That is, since the shift amount Δtd is set to the integral multiple of the AP, the expansion timing and the contraction timing of the ejection channel C1*e*, C2*e* between the plurality of groups G1, G2 are more appropriately adjusted. Thus, the occurrence of the crosstalk described above is further reduced, and as a result, the variation in jetting speed of the ink 9, the variation in droplet size of the ink 9 and so on described above can further be suppressed. Therefore, in the case of adopting this configuration, it becomes possible to further improve the printed image quality.

Further, in the present embodiment, as shown in, for example, FIG. 10C, in the case in which the control section 49 sets the shift amount Δtd (the absolute value |Δtd| of the shift amount Δtd) so as to be equal to the AP (|Δtd|=(1×AP)), the following occurs. That is, since the shift amount Δtd is set so as to be equal to the AP (the same as the AP), the variation in landing position of the droplet of the ink 9 on the recording paper P (the recording target medium) caused by the shift of the jetting timing of the ink 9 due to the setting of the shift amount Δtd is suppressed. Therefore, in the case of adopting the above configuration, it is possible to reduce a density variation of the ink 9 on the recording paper P, and thus, it becomes possible to achieve a further improvement of the printed image quality.

Further, in the present embodiment, as shown in, for example, FIG. 11A, in the case in which the control section 49 stores in advance the information I(Δtd) related to the shift amount Δtd, and at the same time, generates the pulse signals Sp1, Sp2 based on the information I(Δtd) related to the shift amount Δtd thus stored, the following occurs. That is, since the information I(Δtd) related to the shift amount Δtd is stored in the inkjet head 4 in advance, it results in that the trouble of inputting such information from the outside of the inkjet head 4 is saved, and it becomes easy to generate the pulse signals Sp1, Sp2 having the shift amount Δtd.

Therefore, in the case of adopting such a configuration, it becomes possible to enhance the convenience in jetting the ink 9.

In contrast, in the present embodiment, as shown in, for example, FIG. 11B, in the case in which the control section 49 obtains the information I(Δtd) related to the shift amount Δtd from the outside of the inkjet head 4, and at the same time, generates the pulse signals Sp1, Sp2 based on the information I(Δtd) related to the shift amount Δtd thus obtained, the following occurs. That is, since the pulse signals Sp1, Sp2 having the shift amount Δtd are generated based on the information I(Δtd) related to the shift amount Δtd obtained from the outside of the inkjet head 4, it becomes sufficient for the information to be stored in advance in the inkjet head 4 to be small in amount. Therefore, in the case of adopting this configuration, it becomes possible to achieve generalization of the inkjet head 4, reduction of the manufacturing cost, and so on.

Further, in the present embodiment, since the ejection channels C1*e* (C2*e*) belonging to one of the two groups G1, G2 and the ejection channels C1*e* (C2*e*) belonging to the other of the two groups G1, G2 are alternately arranged along the X-axis direction as shown in FIG. 7, the following advantage can also be obtained. That is, since the grouping into the two groups G1, G2 consisting of the odd group Go (the group G1) and the even group Ge (the group G2) is made, the configuration (setting method) of the pulse signals becomes particularly simple. Therefore, in the present embodiment, it is possible to easily perform the drive of the inkjet head 4, and it becomes also possible to achieve an improvement in convenience.

It should be noted that the inkjet heads in the liquid jet recording devices generally fall into the general classification of a shuttle type and an in-line type, and it can be said that the control method described in the present embodiment and so on (e.g., the present embodiment and Modified Examples 1 through 4 described later) exert particularly remarkable advantage in the in-line type. Incidentally, the shuttle type is a system for performing a scanning action with the inkjet head when performing printing on the recording target medium, while the in-line type is a system (also referred to as a one-pass system) for carrying the recording target medium when performing printing on the recording target medium. Here, in the case of the in-line type, it is possible to obtain an advantage that the productivity is dramatically improved on the one hand, but the in-line type tends to be inferior in image quality to the shuttle type since a multi-pass effect cannot be obtained. The multi-pass effect denotes the effect that by performing the printing while performing the scanning operation with the inkjet head a plurality of times, it is difficult for the variation inherent in the inkjet head to appear in the image, and thus, an improvement in image quality can be obtained. In other words, in the case of the in-line type, there is a possibility that the individual variation of the inkjet head appears in the image. For example, in the case in which there is a variation in ejection speed or ejection amount of the ink to be ejected from each of the nozzles in the inkjet head, a variation occurs in the landing position and the luminance despite the intention of printing a uniform image, and thus, it results in that the performance as the image quality deteriorates. Therefore, by using the control method described in the present embodiment and so on, it becomes possible to obtain a high image quality equivalent to the shuttle type even in such an in-line type liquid jet recording device, and thus, it becomes possible to achieve both of the high image quality and the high productivity.

2. Modified Examples

Then, some modified examples (Modified Examples 1 through 4) of the embodiment described above will be described. It should be noted that the same constituents as those in the embodiment are denoted by the same reference symbols, and the description thereof will arbitrarily be omitted.

Modified Example 1

In the embodiment described above, there is described the case of applying one pulse signal (the pulse signal Sp1 or the pulse signal Sp2) alone when jetting one droplet of the ink 9 using the control section 49. In contrast, in Modified Example 1 described below, it is arranged that a plurality of pulse signals is applied as each of the pulse signals Sp1, Sp2 when jetting one droplet of the ink 9 using the control section 49, and it is arranged that the drive method of a so-called "multi-pass system" is performed.

(Setting of Shift Amount ΔTd)

Figures 13A, 13B, 13C:
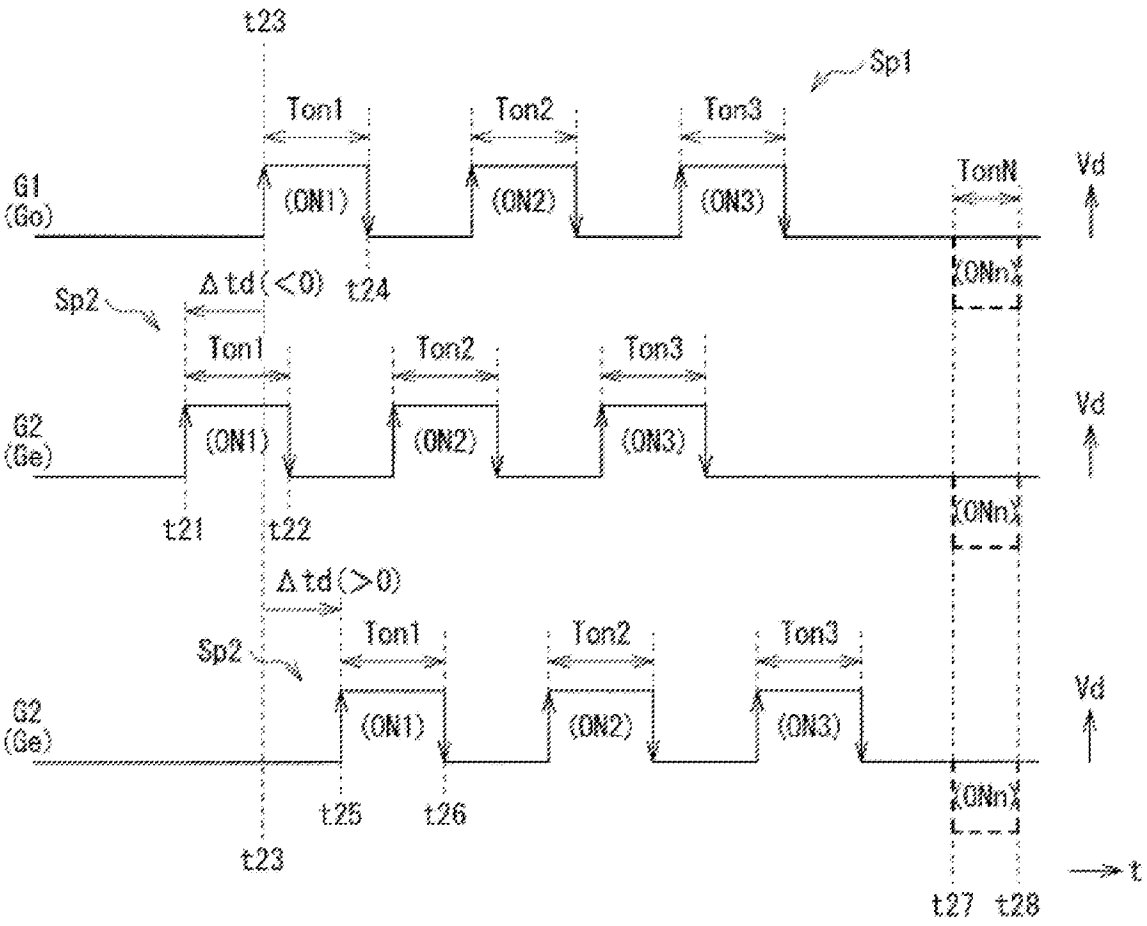
FIGS. 13A through 13C are schematic waveform charts showing an example of a shift amount between pulse signals of respective groups related to Modified Example 1.
Figures 14A, 14B, 14C:
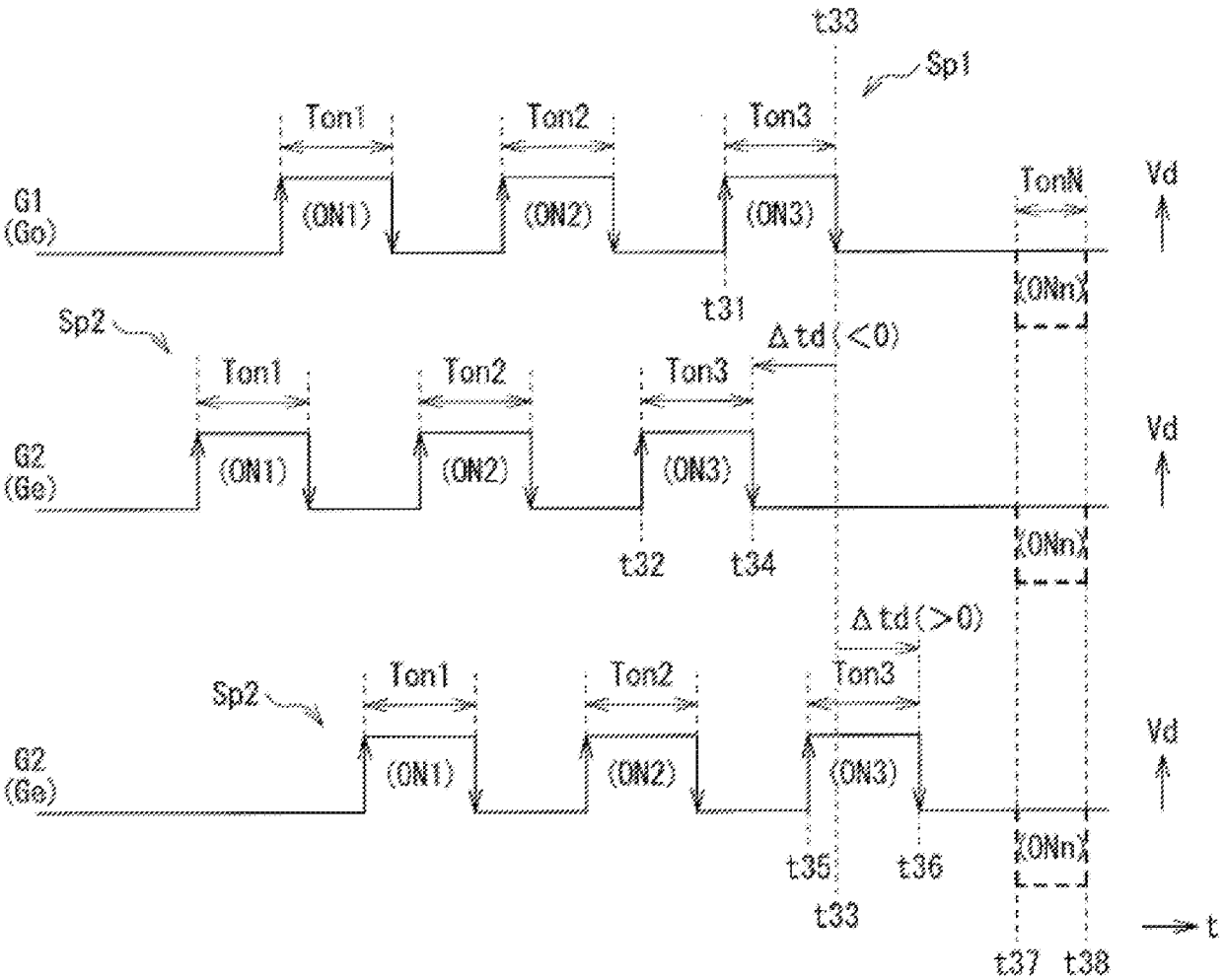
FIGS. 14A through 14C are schematic waveform charts showing another example of the shift amount between the pulse signals of the respective groups related to Modified Example 1.

FIGS. 13A through 13C and FIGS. 14A through 14C are each waveform charts schematically showing an example of the shift amount Δtd between the pulse signals Sp1, Sp2 related to Modified Example 1, wherein the horizontal axis represents time t, and the vertical axis represents the drive voltage Vd (a positive voltage in this example). Specifically, FIGS. 13A through 13C show an example (corresponding to the example shown in FIGS. 8A through 8C in the embodiment) of the case in which the shift amount Δtd is defined between the rising timing of the pulse signal Sp1 in the group G1 (Go) and the rising timing of the pulse signal Sp2 in the group G2 (Ge). In contrast, FIGS. 14A through 14C show an example (corresponding to the example shown in FIGS. 9A through 9C in the embodiment) of the case in which the shift amount Δtd is defined between the falling timing of the pulse signal Sp1 in the group G1 (Go) and the falling timing of the pulse signal Sp2 in the group G2 (Ge).

Here, as shown in FIGS. 13A through 13C and FIGS. 14A through 14C, each of the pulse signals Sp1, Sp2 of Modified Example 1 is provided with a plurality of (three) pulse signals described below as the pulse signals to which the "multi-pulse system" is applied (an example of the case of a so-called "three-drop waveform"). Specifically, as such pulse signals, there are provided three pulse signals, namely a pulse signal having the ON period Ton1 (the pulse width of "ON1"), a pulse signal having the ON period Ton2 (the pulse width of "ON2"), and a pulse signal having an ON period Ton3 (pulse width of "ON3").

It should be noted that also in Modified Example 1, the three pulse signals in each of these pulse signals Sp1, Sp2 are made as follows. That is, these pulse signals are each made as a positive pulse signal for expanding the ejection channel C1*e*, C2*e* in the period of the high state, and at the same time, contracting the ejection channel C1*e*, C2*e* in the period of the low state.

Further, in Modified Example 1, the control section 49 sets the shift amount Δtd with respect to the following pulse signals out of the plurality of pulse signals (the three pulse signals in this example) in each of the pulse signals Sp1, Sp2. That is, the control section 49 sets the shift amount Δtd in substantially the same manner as in the embodiment between the falling timings in, for example, the last pulse signals (the pulse signals having the ON period Ton3 in this example) making a contribution to the jet of the ink 9 (for expanding the capacity of the ejection channel C1*e*, C2*e*). Alternatively, the control section 49 sets the shift amount Δtd in substantially the same manner as in the embodiment between the rising timings in, for example, the first pulse signals (the pulse signals having the ON period Ton1 in this example) making a contribution to the jet of the ink 9.

Here, in the example shown in FIGS. 13A through 13C, the control section 49 sets a predetermined shift amount Δtd between the rising timing of the pulse signal having the ON period Ton1 in the pulse signal Sp1 and the rising timing of the pulse signal having the ON period Ton1 in the pulse signal Sp2. In other words, in this example, as described above, the control section 49 sets the shift amount Δtd between the rising timings in the first pulse signals making a contribution to the jet of the ink 9.

Specifically, the pulse signal having the ON period Ton1 in the pulse signal Sp1 of the group G1 (Go) shown in FIG. 13A is made as a pulse signal rising at the timing t23 and then falling at the timing t24. In contrast, an example of the pulse signal having the ON period Ton1 in the pulse signal Sp2 of the group G2 (Ge) shown in FIG. 13B is made as a pulse signal rising at the timing t21 and then falling at the timing t22. Similarly, an example of the pulse signal having the ON period Ton1 in the pulse signal Sp2 of the group G2 (Ge) shown in FIG. 13C is made as a pulse signal rising at the timing t25 and then falling at the timing t26.

Further, in the example of the case in which the pulse signals Sp1, Sp2 shown in FIG. 13A and FIG. 13B are combined with each other, the shift amount Δtd (the shift amount to the timing t21 based on the timing t23 in this example) described above takes a negative value (Δtd<0). In contrast, in the example of the case in which the pulse signals Sp1, Sp2 shown in FIG. 13A and FIG. 13C are combined with each other, the shift amount Δtd (the shift amount to the timing t25 based on the timing t23 in this example) described above takes a positive value (Δtd>0).

Further, in the example shown in FIGS. 14A through 14C, the control section 49 sets a predetermined shift amount Δtd between the falling timing of the pulse signal having the ON period Ton3 in the pulse signal Sp1 and the falling timing of the pulse signal having the ON period Ton3 in the pulse signal Sp2. In other words, in this example, as described above, the control section 49 sets the shift amount Δtd between the falling timings in the last pulse signals making a contribution to the jet of the ink 9.

Specifically, the pulse signal having the ON period Ton3 in the pulse signal Sp1 of the group G1 (Go) shown in FIG. 14A is made as a pulse signal rising at the timing t31 and then falling at the timing t33. In contrast, an example of the pulse signal having the ON period Ton3 in the pulse signal Sp2 of the group G2 (Ge) shown in FIG. 14B is made as a pulse signal rising at the timing t32 and then falling at the timing t34. Similarly, an example of the pulse signal having the ON period Ton3 in the pulse signal Sp2 of the group G2 (Ge) shown in FIG. 14C is made as a pulse signal rising at the timing t35 and then falling at the timing t36.

Further, in the example of the case in which the pulse signals Sp1, Sp2 shown in FIG. 14A and FIG. 14B are combined with each other, the shift amount Δtd (the shift amount to the timing t34 based on the timing t33 in this example) described above takes a negative value (Δtd<0). In contrast, in the example of the case in which the pulse signals Sp1, Sp2 shown in FIG. 14A and FIG. 14C are combined with each other, the shift amount Δtd (the shift amount to the timing t36 based on the timing t33 in this example) described above takes a positive value (Δtd>0).

In such a manner as described above, also in Modified Example 1, since the shift amount Δtd is set in substantially the same manner as in the embodiment with respect to the plurality of pulse signals in each of the pulse signals Sp1, Sp2, the following occurs. That is, also in the case of the multi-pass system, it results in that the function of reducing the occurrence of the crosstalk described in the embodiment is exerted. Therefore, also in Modified Example 1, it becomes possible to obtain substantially the same advantages as those of the embodiment. Specifically, it is possible to suppress the variation in the ejection speed of the ink 9, the variation in droplet size of the ink 9 and so on between the plurality of nozzles (the nozzle holes H1 or the nozzle holes H2), and thus, it becomes possible to improve the printed image quality.

Further, in particular in Modified Example 1, since the shift amount Δtd described above is set between the falling timings in the last pulse signals, or between the rising timings in the first pulse signals making a contribution to the jet of the ink 9 (for jetting the ink 9) as described above, the following occurs. That is, in the case of adopting such a configuration, it becomes easy to define the shift amount Δtd between the pulse signals Sp1, Sp2. Further, in particular in the case of the shift amount Δtd between the falling timings in the last pulse signals described above, it becomes possible to more efficiently exert the reduction action of the crosstalk described above. Therefore, in the case of adopting such a configuration, it becomes possible to enhance the convenience in jetting the ink 9.

It should be noted that in Modified Example 1, in the case of the multi-pulse system, the description is presented citing the case of the "three-drop waveform" as an example. However, this example is not a limitation, and it is also possible to arrange that the shift amount Δtd is set in substantially the same manner as in Modified Example 1 with respect also to the case of a "two-drop waveform or four-or-more-drop waveform."

(Regarding Case of Adding Pulse Signal for Contracting Capacity)

Here, in Modified Example 1, in the case of adding a pulse signal for contracting the capacity of each of the ejection channels C1*e*, C2*e* to the pulse signal having a contribution (for expanding the capacity of each of the ejection channels C1*e*, C2*e*) to the jet of the ink 9 as described above, the control section 49 performs setting of the shift amount Δtd in, for example, a following manner. It should be noted that it can also be said that the pulse signal for contracting the capacity of each of the ejection channels C1*e*, C2*e* is a pulse signal for further contracting the capacity of each of the ejection channels C1*e*, C2*e* after once contracting the capacity of each of the ejection channels C1*e*, C2*e* having been expanded.

In the example shown in FIGS. 13A through 13C and FIGS. 14A through 14C, firstly, in each of the pulse signals Sp1, Sp2, there are provided the three pulse signals, namely the pulse signal having the ON period Ton1 described above, the pulse signal having the ON period Ton2, and the pulse signal having the ON period Ton3, as the pulse signals for expanding the capacity of each of the ejection channels C1*e*, C2*e*. Further, as indicated with dotted lines in, for example, FIGS. 13A through 13C and FIG. 14A through 14C, each of the pulse signals Sp1, Sp2 is additionally provided with the pulse signal having the ON period TonN (the pulse width of "ONn") as the pulse signal for contracting the capacity of each of the ejection channels C1*e*, C2*e*.

It should be noted that such a pulse signal for expanding the capacity of each of the ejection channels C1*e*, C2*e* corresponds to a specific example of a "first pulse signal" in the present disclosure. Further, the pulse signal for expanding the capacity of each of the ejection channels C1*e*, C2*e* corresponds to a specific example of a "second pulse signal" in the present disclosure.

In such a case, the control section 49 sets, for example, the pulse signals (the three pulse signals having the ON periods Ton1 through Ton3 in this example) for expanding the capacity of each of the ejection channels C1*e*, C2*e* so as to have the shift amount Δtd as described hereinabove (see FIGS. 13A through 13C and FIGS. 14A through 14C). In contrast, the control section 49 sets, for example, the pulse signal (the pulse signals having the ON periods TonN in this example) for expanding the capacity of each of the ejection channels C1*e*, C2*e* so as not to have the shift amount Δtd. In other words, in the example shown in FIGS. 13A through 13C and FIGS. 14A through 14C, the pulse signal having the ON period TonN is made as a pulse signal rising at the timing t27, t27 and then falling at the timing t28, t38 commonly in the pulse signals Sp1, Sp2.

In the case of arranging that such selective setting of the shift amount Δtd is performed, the following occurs. That is, since the pulse signals for expanding the capacity of each of the ejection channels C1*e*, C2*e* have a principal contribution to the reduction action of the crosstalk described above, by selectively performing setting of the shift amount Δtd with respect to such pulse signals for expanding the capacity, it becomes possible to more effectively exert the reduction action of the crosstalk. This is because the suction amount of the ink 9 is larger in expanding the capacity of each of the ejection channels C1*e*, C2*e* than in contracting the capacity of each of the ejection channels C1*e*, C2*e*, and therefore, the repercussions (described above) generated in each of the ejection channels C1*e*, C2*e* becomes stronger, and thus, the influence on other adjacent ejection channels C1*e*, C2*e* becomes more significant. As a result, in the case of adopting such a configuration, it is possible to suppress the variation in the ejection speed of the ink 9, the variation in droplet size of the ink 9 and so on between the plurality of nozzles (the nozzle holes H1 or the nozzle holes H2), and thus, it becomes possible to further improve the printed image quality.

It should be noted that it is also possible to arrange that such selective setting of the shift amount Δtd is performed not only in the case of Modified Example 1 shown in FIGS. 13A through 13C and FIGS. 14A through 14C, but also in the case in which a single pulse signal for expanding the capacity of each of the ejection channels C1*e*, C2*e* is used alone as in, for example, the embodiment described above.

(Experimental Results)

Here, FIGS. 15A through 15C are diagrams showing the experimental result of the luminance related to Modified Example 1 and the comparative example, and show an example of the correspondence relationship between the position on the recording paper P and the luminance (the luminance of the image on the recording paper P) expressed by the ink 9. Specifically, FIG. 15A shows the experimental result in the case of using the pulse signal Sp101 (see FIG. 12) related to the comparative example described above (corresponding to the case of Δtd=0). In contrast, FIG. 15B and FIG. 15C each show the experimental result in the case of using the pulse signals Sp1, Sp2 (see FIGS. 13A through 13C and FIGS. 14A through 14C) related to Modified Example 1. Further, FIG. 15B shows the experimental result in the case of Δtd=+(1×AP), and FIG. 15C shows the experimental result in the case of Δtd=−(1×AP).

Firstly, in the experimental result related to the comparative example shown in FIG. 15A, it is understood that the positional variation of the luminance of the image on the recording paper P has increased due to the variation in the jetting speed of the ink 9, the variation in the droplet size of the ink 9 and so on described above as in, for example, the part indicated by the reference symbol P201.

In contrast, in both of the experimental results related to Modified Example 1 shown in FIG. 15B and FIG. 15C, it is understood that the positional variation of the luminance of the image on the recording paper P is suppressed compared to the experimental result of the comparative example described above. This is because the variation in the jetting speed of the ink 9, the variation in the droplet size of the ink 9 and so on are suppressed in Modified Example 1 compared to the comparative example as described above. Therefore, according to these experimental results, it can be said that an example of the advantage in Modified Example 1 can specifically be confirmed.

Modified Example 2

FIG. 16 is a diagram showing a setting example of the shift amount Δtd between the pulse signals Sp1, Sp2 of the respective groups G1, G2 related to Modified Example 2 in the form of a table. Specifically, in FIG. 16, there is shown an example of a correspondence relationship between the droplet size Sd (which can be set at a plurality of levels) of the ink 9 to be jetted from the inkjet head 4 and presence or absence of the shift amount Δtd described hereinabove.

As shown in FIG. 16, in Modified Example 2, the control section 49 is arranged to set the droplet size Sd of the ink 9 at a plurality of levels, and at the same time, set the presence or absence of the shift amount Δtd in accordance with the volume of the droplet size Sd thus set. It should be noted that such volume of the droplet size Sd of the ink 9 is arranged to increase or decrease in accordance with, for example, the number, the crest value, the pulse width and so on of the pulse signals Sp1, Sp2.

Further, as shown in FIG. 16, in the case in which, for example, the droplet size Sd thus set is smaller than a predetermined threshold value Sth (Sd<Sth), the control section 49 performs the setting of providing the shift amount Δtd (Δtd≠0). In contrast, in the case in which, for example, the droplet size Sd thus set is no smaller than the threshold value Sth described above (Sd≥Sth), the control section 49 performs the setting of not providing the shift amount Δtd (Δtd=0). Specifically, for example, in the case (Sd<Sth, e.g., in the case of "one-drop waveform or two-drop waveform") in which the number of the pulse signals Sp1 (Sp2) is one or two, the setting of providing the shift amount Δtd is performed. In contrast, for example, in the case (Sd≥Sth, e.g., in the case of "three-or-more-drop waveform") in which the number of the pulse signals Sp1 (Sp2) is three or more, the setting of not providing the shift amount Δtd is performed.

In such a manner, in Modified Example 2, since the presence or absence of the shift amount Δtd is set in accordance with the volume of the droplet size Sd to be set in the case of the multi-pulse system (the system of controlling the droplet size in accordance with the number and so on of the pulse signals) described above, the following occurs. That is, it becomes possible to more effectively exert the reduction action of the crosstalk described above in accordance with the droplet size Sd. As a result, in Modified Example 2, since it is possible to further suppress the variation in the jetting speed of the ink 9, the variation in droplet size of the ink 9 and so on between the plurality of nozzles (the nozzle holes H1 or the nozzle holes H2), it becomes possible to further improve the printed image quality.

Further, in Modified Example 2, in the case of arranging that the presence or absence of the shift amount Δtd is set in accordance with the magnitude relationship between the droplet size Sd to be set and the predetermined threshold value Sth as described above, the following occurs. That is, firstly, the crosstalk described above is more effectively reduced due to the setting of the shift amount Δtd in the case in which the droplet size Sd is smaller than the threshold value Sth (the droplet size Sd is relatively small) compared to the case in which the droplet size Sd is no smaller than the threshold value Sth (the droplet size Sd is relatively large), and therefore, it becomes easy to reduce the crosstalk. This is because in the case in which the droplet size Sd is relatively large, a sufficient amount of the ink 9 is applied on the recording paper P (the recording target medium) to saturate the density of the ink 9, and thus, it becomes difficult to generate a difference in thickness. As a result, in the case in which the droplet size Sd is relatively large, it becomes unnecessary to set the shift amount Δtd, and therefore the variation in the jetting speed of the ink 9, the variation in droplet size of the ink 9 and so on are further suppressed between the plurality of nozzles (the nozzle holes H1 or the nozzle holes H2). Therefore, in the case of adopting this configuration, it becomes possible to further improve the printed image quality.

Modified Example 3

FIG. 17 is a diagram showing an adjustment example of the jetting speed V9 of the ink 9 related to Modified Example 3 in the form of a table. Specifically, in FIG. 17, there is shown an example of the correspondence relationship between the jet timing of the ink 9 in each of the plurality of groups G1, G2 due to the setting of the shift amount Δtd described hereinabove, and the jetting speed V9 of the ink 9 jetted from the inkjet head 4.

As shown in FIG. 17, in Modified Example 3, the control section 49 performs the setting (waveform adjustment of the pulse signals Sp1, Sp2) of the jetting speed V9 of the ink 9 in the following manner.

That is, firstly, the control section 49 performs the waveform adjustment of the pulse signals Sp1, Sp2 so that the jetting speed V9 of the ink 9 becomes relatively low in the group in which the jet timing of the ink 9 is relatively accelerated due to the setting of the shift amount Δtd out of the plurality of groups G1, G2 compared to the rest of the groups.

Alternatively, the control section 49 performs the waveform adjustment of the pulse signals Sp1, Sp2 so that the jetting speed V9 of the ink 9 becomes relatively high in the group in which the jet timing of the ink 9 is relatively delayed due to the setting of the shift amount Δtd out of the plurality of groups G1, G2 compared to the rest of the groups.

In such a manner, in Modified Example 3, since the waveform adjustment of the pulse signals Sp1, Sp2 is performed so that the jetting speed V9 of the ink 9 varies in accordance with the jet timing of the ink 9 due to the setting of the shift amount Δtd, the following occurs. That is, it results in that the variation in landing position of the droplet of the ink 9 on the recording paper P due to such a shift of the jet timing of the ink 9 is suppressed. Therefore, in Modified Example 3, it is possible to reduce a density variation of the ink 9 on the recording paper P, and thus, it becomes possible to achieve a further improvement of the printed image quality.

Modified Example 4

In each of the embodiment and Modified Examples 1 through 3 having already been described, the plurality of ejection channels adjacent to each other in each of the channel columns is set so as to respectively belong to the plurality of groups different from each other.

In contrast, in Modified Example 4 described below, there is described the case in which a structure for supplying the ink commonly to the ejection channels in the plurality of channel columns is adopted, and at the same time, the plurality of ejection channels adjacent to each other between the channel columns is also set so as to respectively belong to the plurality of groups different from each other.

(Configuration of Cover Plate 43A)

Figure 18:
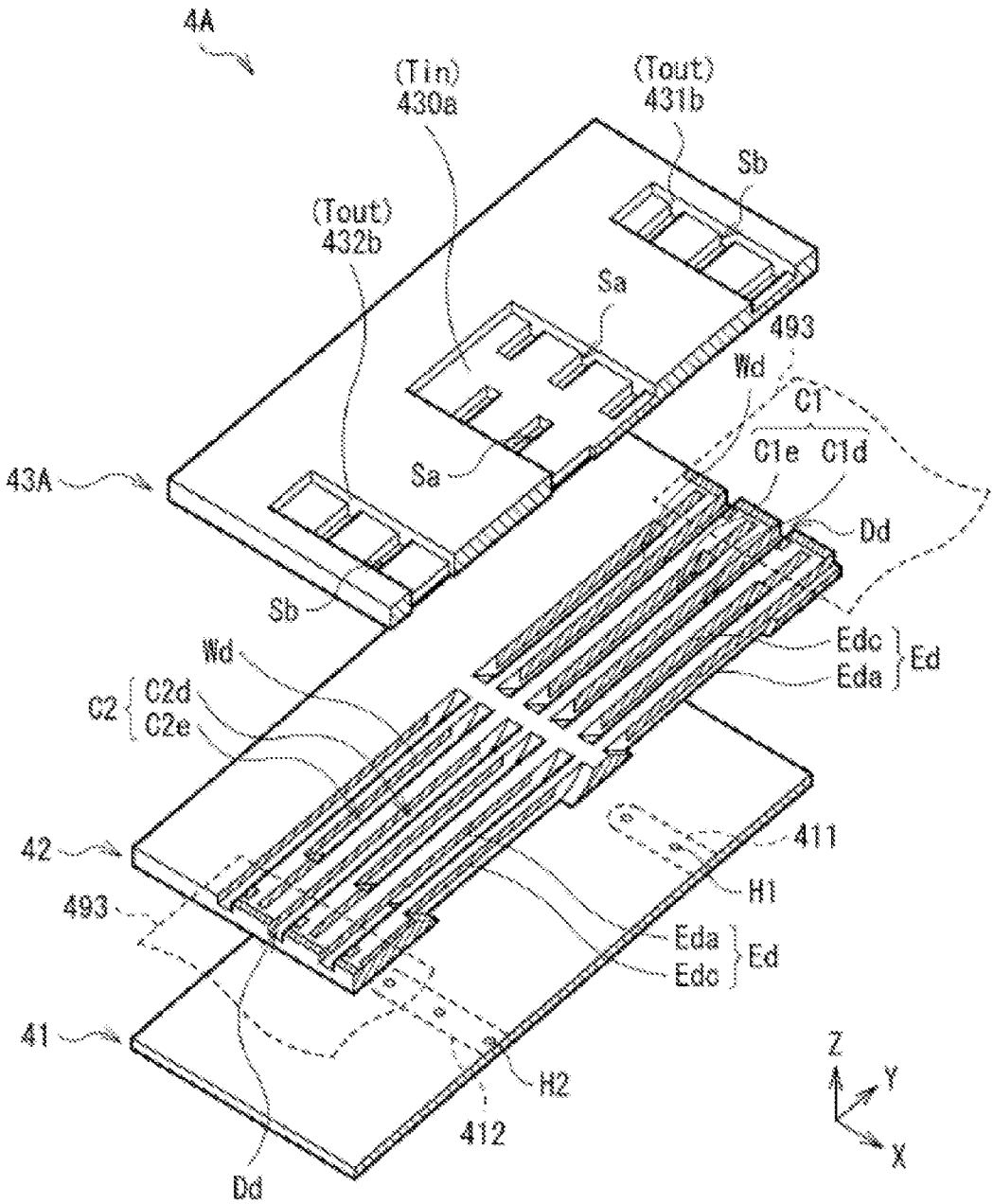
FIG. 18 is an exploded perspective view showing a configuration example of a liquid jet head related to Modified Example 4.

FIG. 18 is an exploded perspective view showing a configuration example of an inkjet head (an inkjet head 4A) related to Modified Example 4. The inkjet head 4A of Modified Example 4 corresponds to what is obtained by disposing a cover plate 43A described below instead of the cover plate 43 in the inkjet head 4 described in the embodiment.

In the cover plate 43A, one entrance side common ink chamber 430*a* is provided as shown in FIG. 18 instead of the two entrance side common ink chambers 431*a*, 432*a* in the cover plate 43. The entrance side common ink chamber 431*a* supplies the ink 9 to the plurality of ejection channels C1*e* adjacent to each other in the channel column 421, while the entrance side common ink chamber 432*a* supplies the ink 9 to the plurality of ejection channels C2*e* adjacent to each other in the channel column 422. In other words, the entrance side common ink chambers 431*a*, 432*a* individually supply the ink 9 to the plurality of ejection channels C1*e*, C2*e* in the channel columns 421, 422, respectively. In contrast, the entrance side common ink chamber 430*a* of Modified Example 4 is arranged to supply the ink 9 commonly to the plurality of ejection channels C1*e*, C2*e* adjacent to each other between the channel columns 421, 422.

It should be noted that such an entrance side common ink chamber 430*a* is formed as a part constituting an entrance part Tin in the inkjet head 4A, and corresponds to a specific example of a "common liquid supply chamber" in the present disclosure.

(Regarding Setting of Grouping)

Figure 19:
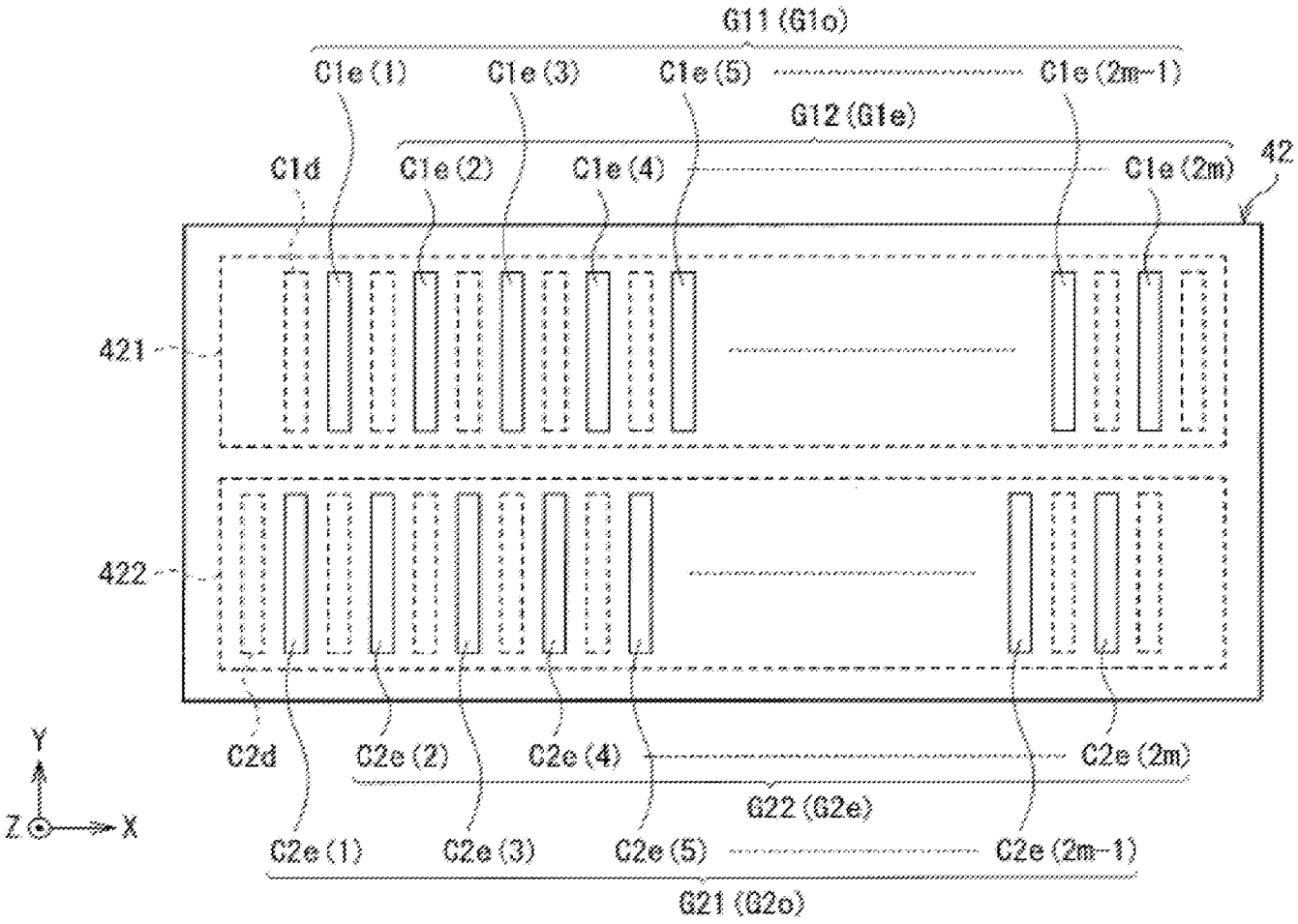
FIG. 19 is a schematic plan view showing a configuration example of grouping of pressure chambers related to Modified Example 4.

FIG. 19 is a plan view (an X-Y plan view) schematically showing a configuration example of grouping of the ejection channels C1*e*, C2*e* related to Modified Example 4.

In the case of the control operation of Modified Example 4, as shown in FIG. 19, the plurality of ejection channels C1*e* in the channel column 421 and the plurality of ejection channels C2*e* in the channel column 422 are each grouped into the two groups (the odd group and the even group described above) similarly to the embodiment (see FIG. 7). Further, in Modified Example 4, unlike the embodiment, the plurality of ejection channels in the channel column 421 and the plurality of ejection channels C2*e* in the channel column 422 are also grouped into different groups. Therefore, in Modified Example 4, as shown in FIG. 19, there are provided four groups, namely a group G11 functioning as an odd group G1*o*, a group G12 functioning as an even group G1*e*, a group G21 functioning as an odd group G2*o*, and a group G22 functioning as an even group G2*e*.

The ejection channels C1*e* arranged at odd-numbered (1-st, 3-rd, 5-th, . . . ) places starting from one end part along the X-axis direction in the channel column 421 are arranged to belong to the group G11 (G1*o*). Specifically, as shown in FIG. 19, the 1-st ejection channel C1*e*(1), the 3-rd ejection channel C1*e*(3), the 5-th ejection channel C1*e*(5), . . . , and the (2m−1)-th (m is a positive integer) ejection channel C1*e*(2m−1) belong to the group G11.

Further, the ejection channels C2*e* arranged at odd-numbered (1-st, 3-rd, 5-th, . . . ) places starting from the one end part along the X-axis direction in the channel column 422 are arranged to belong to the group G21 (G2*o*). Specifically, as shown in FIG. 19, the 1-st ejection channel C2*e*(1), the 3-rd ejection channel C2*e*(3), the 5-th ejection channel C2*e*(5), . . . , and the (2m−1)-th ejection channel C2*e*(2m−1) belong to the group G21.

On the other hand, the ejection channels C1*e* arranged at even-numbered (2-nd, 4-th, 6-th, . . . ) places starting from the one end part along the X-axis direction in the channel column 421 are arranged to belong to the group G12 (G1*e*). Specifically, as shown in FIG. 19, the 2-nd ejection channel C1*e*(2), the 4-th ejection channel C1*e*(4), the 6-th ejection channel C1*e*(6), . . . , and the (2m)-th ejection channel C1*e*(2m) belong to the group G12.

Further, the ejection channels C2*e* arranged at even-numbered (2-nd, 4-th, 6-th, . . . ) places starting from the one end part along the X-axis direction in the channel column 422 are arranged to belong to the group G22 (G2*e*). Specifically, as shown in FIG. 19, the 2-nd ejection channel C2*e*(2), the 4-th ejection channel C2*e*(4), the 6-th ejection channel C2*e*(6), . . . , and the (2m)-th ejection channel C2*e*(2m) belong to the group G22.

As described above, in Modified Example 4, the ejection channels C1*e* belonging to the group G11 (G1*o*) and the ejection channels C1*e* belonging to the group G12 (G1*e*) are arranged alternately along the X-axis direction, and at the same time, the ejection channels C2*e* belonging to the group G21 (G2*o*) and the ejection channels C2*e* belonging to the group G22 (G2*e*) are arranged alternately along the X-axis direction.

(Functions/Advantages)

In such a manner as described above, in Modified Example 4, since there is provided the entrance side common ink chamber 430*a* for supplying the ink 9 commonly to the plurality of ejection channels C1*e*, C2*e* adjacent to each other between the channels columns 421, 422, and it is arranged that the plurality of ejection channels C1*e*, C2*e* adjacent to each other between the channel columns 421, 422 respectively belong to the plurality of groups different from each other, the following is achieved. That is, when supplying the ink 9 commonly to the plurality of ejection channels C1*e*, C2*e* adjacent to each other from the entrance side common ink chamber 430*a*, the instantaneous flow in one direction of the ink 9 or the like can be suppressed in the plurality of ejection channels C1*e*, C2*e* adjacent to each other. Therefore, even in the case of providing such an entrance side common ink chamber 430*a*, by setting the shift amount Δtd in substantially the same manner as in the embodiment and so on, it becomes possible to improve the printed image quality.

(Experimental Results)

Here, FIGS. 20A through 20C are diagrams showing the experimental result of the luminance related to Modified Example 4 and the comparative example, and show an example of the correspondence relationship between the position on the recording paper P and the luminance (the luminance of the image on the recording paper P) expressed by the ink 9. Specifically, FIG. 20A shows the experimental result in the case of using the pulse signal Sp101 (see FIG. 12) related to the comparative example described above (corresponding to the case of Δtd=0). In contrast, FIG. 20B and FIG. 20C each show the experimental result in the case of using the pulse signals Sp1, Sp2 in the case of setting the grouping (see FIG. 19) related to Modified Example 4. Further, FIG. 20B shows the experimental result in the case of Δtd=+(1×AP), and FIG. 20C shows the experimental result in the case of Δtd=−(1×AP).

Firstly, in the experimental result related to the comparative example shown in FIG. 20A, it is understood that the positional variation of the luminance of the image on the recording paper P has increased due to the variation in the jetting speed of the ink 9, the variation in the droplet size of the ink 9 and so on described above as in, for example, the part indicated by the reference symbol P301. Further, in the experimental result related to the comparative example shown in FIG. 20A, it is also understood that the luminance of the image on the recording paper P remarkably increases to cause a white line as in, for example, the part (the peak part) indicated by the reference symbol P302.

In contrast, in both of the experimental results related to Modified Example 4 shown in FIG. 20B and FIG. 20C, it is understood that the positional variation of the luminance of the image on the recording paper P is suppressed compared to the experimental result of the comparative example described above. This is because the variation in the jetting speed of the ink 9, the variation in the droplet size of the ink 9 and so on are suppressed in Modified Example 4 compared to the comparative example as described above. Further, in both of the experimental results related to Modified Example 4 shown in FIG. 20B and FIG. 20C, it is also understood that the white line (the peak part) described above is not caused unlike the experimental result of the comparative example described above. Therefore, according to these experimental results, it can be said that an example of the advantage in Modified Example 4 can specifically be confirmed.

3. Other Modified Examples

The present disclosure is described hereinabove citing the embodiment and some modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer 1 and the inkjet head 4, but what is described in the above embodiment and so on is not a limitation, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, in the embodiment and so on described above, the description is presented citing the inkjet head 4 of the two-column type (having the two nozzle columns 411, 412), but the example is not a limitation. Specifically, for example, it is also possible to adopt an inkjet head of a single-column type (having a single nozzle column), or an inkjet head of a multi-column type (having three or more nozzle columns) with three or more columns.

Further, for example, in the embodiment described above and so on, there is described the case in which the ejection channels (the ejection grooves) and the dummy channels (the non-ejection grooves) each extend along the Y-axis direction in the actuator plate 42, but this example is not a limitation. Specifically, it is also possible to arrange that, for example, the ejection channels and the dummy channels extend along an oblique direction in the actuator plate 42.

Further, the shape of each of the nozzle holes H1, H2 is not limited to the circular shape as described in the above embodiment and so on, but can also be, for example, a polygonal shape such as a triangular shape, an elliptical shape, or a star shape.

In addition, in the embodiment and so on described above, the example of the so-called side-shoot type inkjet head fir ejecting the ink 9 from the central part in the extending direction (the Y-axis direction) of the ejection channels C1*e*, C2*e* is described, but the example is not a limitation. Specifically, it is also possible to apply the present disclosure to a so-called edge-shoot type inkjet head for ejecting the ink 9 along the extending direction of the ejection channels C1*e*, C2*e*.

Further, in the embodiment described above, the description is presented citing the circulation type inkjet head for using the ink 9 while circulating the ink 9 mainly between the ink tank and the inkjet head as an example, but the example is not a limitation. Specifically, it is also possible to apply the present disclosure to a non-circulation type inkjet head using the ink 9 without circulating the ink 9.

Further, in the embodiment and so on described above, the description is presented specifically citing the method of the control operation by the control section 49, but the example cited in the embodiment and so on described above is not a limitation, and it is also possible to arrange to perform the control operation using other methods. Specifically, for example, the method of grouping the ejection channels C1*e*, C2*e* is not limited to the method described in the embodiment and so on described above, but it is also possible to arrange that, for example, the grouping into three or more groups is adopted, or the ejection channels adjacent to each other are defined in a direction different from the direction along each of the channel columns or the direction between the channel columns.

In addition, in the embodiment and so on described above, there is described the case in which the pulse signal for expanding the capacity of the ejection channel C1*e*, C2*e* is the pulse signal (the positive pulse signal) for expanding the capacity during the period of the high state, but the case is not a limitation. Specifically, besides the case of the pulse signal for expanding the capacity during the period of the high state and contracting the capacity during the period of the low state, it is also possible to adopt a pulse signal (a negative pulse signal) for expanding the capacity during the period of the low state and contracting the capacity during the period of the high state by contraries.

Further, for example, it is also possible to arrange that a signal for helping the ejection of the droplet is additionally applied during the OFF period immediately after the ON period. As the signal for helping the ejection of the droplet, there can be cited, for example, a pulse signal for contracting the capacity of each of the ejection channels C1*e*, C2*e*, and a pulse signal (an auxiliary pulse signal) for pulling back a part of the droplet having been ejected as described above. Further, the pulse signal (the main pulse signal) to be applied immediately before the auxiliary pulse signal as latter one of the pulses has, for example, the pulse width no larger than the width of the on-pulse peak (AP). It should be noted that even if such a signal for helping the ejection of the droplet is added, the content (e.g., the drive method) of the present disclosure described hereinabove is not affected.

Further, the series of processes described in the above embodiment and so on can be arranged to be performed by hardware (a circuit), or can also be arranged to be performed by software (a program). In the case of arranging that the series of processes is performed by the software, the software is constituted by a program group for making the computer perform the functions. The programs can be incorporated in advance in the computer described above, and are then used, or can also be installed in the computer described above from a network or a recording medium and are then used. Further, such a program corresponds to a specific example of a "program for driving a liquid jet head" in the present disclosure.

In addition, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head 4) of the present disclosure is applied to other devices than the inkjet printer. Specifically, for example, it is also possible to arrange that the "liquid jet head" of the present disclosure is applied to a device such as a facsimile or an on-demand printer.

Further, in the embodiment and so on described above, the description is presented citing the shuttle type printer described above as an example, but this example is not a limitation. It is also possible to apply the control method described in the embodiment and so on described above to, for example, the in-line type printer described above.

Further, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1>

A liquid jet head comprising: a plurality of nozzles adapted to jet liquid; a piezoelectric actuator having a plurality of pressure chambers communicated individually with the nozzles and each filled with the liquid, and adapted to change a capacity of each of the pressure chambers; and a control section adapted to apply at least one pulse signal to the piezoelectric actuator to thereby expand and contract the capacity of the pressure chambers to jet the liquid filling the pressure chamber, wherein the pressure chambers adjacent to each other in the plurality of the pressure chambers are set so as to belong to a plurality of groups different from each other, and the control section makes the pulse signals different in timing between the plurality of groups and sets a shift amount of the timing in the pulse signals between the respective groups so as to approximate an integral multiple of an on-pulse peak (AP), when jetting the liquid.

<2>

The liquid jet head according to <1>, wherein the control section sets the shift amount so as to be an integral multiple of the AP, when jetting the liquid.

<3>

The liquid jet head according to <2>, wherein the control section sets the shift amount so as to be equal to the AP, when jetting the liquid.

<4>

The liquid jet head according to any one of <1> to <3>, wherein the control section sets a droplet size of the liquid to be jetted at a plurality of levels, and the control section sets presence or absence of the shift amount in accordance with a volume of the droplet size to be set.

<5>

The liquid jet head according to <4>, wherein the control section performs setting so that the shift amount is present in a case in which the droplet size to be set is smaller than a predetermined threshold value, and the control section performs setting so that the shift amount is absent in a case in which the droplet size to be set is no smaller than the threshold value.

<6>

The liquid jet head according to any one of <1> to <5>, wherein the plurality of pulse signals includes a first pulse signal adapted to expand the capacity of the pressure chamber, and a second pulse signal adapted to contract the capacity of the pressure chamber, the control section performs setting so that the shift amount is present with respect to the first pulse signal, and the control section performs setting so that the shift amount is absent with respect to the second pulse signal.

<7>

The liquid jet head according to any one of <1> to <6>, wherein the control section adjusts a waveform of the pulse signal so that jetting speed of the liquid becomes relatively low with respect to the group, in which jet timing of the liquid is relatively accelerated due to setting of the shift amount, out of the plurality of groups, or so that jetting speed of the liquid becomes relatively high with respect to the group, in which jet timing of the liquid is relatively delayed due to setting of the shift amount, out of the plurality of groups.

<8>

The liquid jet head according to any one of <1> to <7>, further comprising: at least one common liquid supply chamber adapted to supply the liquid commonly to the plurality of pressure chambers adjacent to each other.

<9>

The liquid jet head according to any one of <1> to <8>, wherein the shift amount is a shift amount between falling timings in last pulse signals adapted to jet the liquid out of the at least one pulse signal, or a shift amount between rising timings in first pulse signals adapted to jet the liquid out of the at least one pulse signal.

<10>

The liquid jet head according to any one of <1> to <9>, wherein the control section stores information related to the shift amount in advance, and the control section generates the pulse signal based on the information related to the shift amount stored therein.

<11>

The liquid jet head according to any one of <1> to <9>, wherein the control section obtains information related to the shift amount from an outside of the liquid jet head, and the control section generates the pulse signal based on the information related to the shift amount obtained from the outside.

<12>

The liquid jet head according to any one of <1> to <11>, wherein the plurality of groups is two groups, the pressure chambers belonging to one of the two groups and the pressure chambers belonging to the other of the two groups being arranged alternately.

<13>

A liquid jet recording device comprising: the liquid jet head according to any one of <1> to <12>.

<14>

A method for driving a liquid jet head, comprising: setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other; and making the pulse signals different in timing between the plurality of groups and setting a shift amount of the timing in the pulse signals between the respective groups so as to approximate an integral multiple of an on-pulse peak (AP).

<15>

A program for driving a liquid jet head, the program making a computer perform a process comprising: setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other; and making the pulse signals different in timing between the plurality of groups and setting a shift amount of the timing in the pulse signals between the respective groups so as to approximate an integral multiple of an on-pulse peak (AP).

What is claimed is:

1. A liquid jet head comprising:

a plurality of nozzles adapted to jet liquid;

a piezoelectric actuator having a plurality of pressure chambers communicated individually with the nozzles and each filled with the liquid, and adapted to change a capacity of each of the pressure chambers; and a control section adapted to apply at least one pulse signal to the piezoelectric actuator to thereby expand and contract the capacity of the pressure chambers to jet the liquid filling the pressure chamber, wherein the pressure chambers adjacent to each other in the plurality of the pressure chambers are set so as to belong to a plurality of groups different from each other, the control section makes the pulse signals different in timing between the plurality of groups and sets a shift amount of the timing in the pulse signals between the respective groups so as to approximate an integral multiple of an on-pulse peak (AP), when jetting the liquid, and the pressure chambers belonging to the plurality of groups are arranged side by side along one pressure chamber column.

2. The liquid jet head according to claim 1, wherein the control section sets the shift amount so as to be an integral multiple of the AP, when jetting the liquid.

3. The liquid jet head according to claim 2, wherein the control section sets the shift amount so as to be equal to the AP, when jetting the liquid.

4. The liquid jet head according to claim 1, wherein the control section sets a droplet size of the liquid to be jetted at a plurality of levels, and the control section sets presence or absence of the shift amount in accordance with a volume of the droplet size to be set.

5. The liquid jet head according to claim 4, wherein the control section performs setting so that the shift amount is present in a case in which the droplet size to be set is smaller than a predetermined threshold value, and the control section performs setting so that the shift amount is absent in a case in which the droplet size to be set is no smaller than the threshold value.

6. The liquid jet head according to claim 1, wherein the plurality of pulse signals includes a first pulse signal adapted to expand the capacity of the pressure chamber, and a second pulse signal adapted to contract the capacity of the pressure chamber, the control section performs setting so that the shift amount is present with respect to the first pulse signal, and the control section performs setting so that the shift amount is absent with respect to the second pulse signal.

7. The liquid jet head according to claim 1, wherein the control section adjusts a waveform of the pulse signal so that jetting speed of the liquid becomes relatively low with respect to the group, in which jet timing of the liquid is relatively accelerated due to setting of the shift amount, out of the plurality of groups, or so that jetting speed of the liquid becomes relatively high with respect to the group, in which jet timing of the liquid is relatively delayed due to setting of the shift amount, out of the plurality of groups.

8. The liquid jet head according to claim 1, further comprising:

at least one common liquid supply chamber adapted to supply the liquid commonly to the plurality of pressure chambers adjacent to each other.

9. The liquid jet head according to claim 1, wherein the shift amount is a shift amount between falling timings in last pulse signals adapted to jet the liquid out of the at least one pulse signal, or a shift amount between rising timings in first pulse signals adapted to jet the liquid out of the at least one pulse signal.

10. The liquid jet head according to claim 1, wherein the control section stores information related to the shift amount in advance, and the control section generates the pulse signal based on the information related to the shift amount stored therein.

11. The liquid jet head according to claim 1, wherein the control section obtains information related to the shift amount from an outside of the liquid jet head, and the control section generates the pulse signal based on the information related to the shift amount obtained from the outside.

12. The liquid jet head according to claim 1, wherein the plurality of groups is two groups, the pressure chambers belonging to one of the two groups and the pressure chambers belonging to the other of the two groups being arranged alternately.

13. A liquid jet recording device comprising:

the liquid jet head according to claim 1.

14. A method for driving a liquid jet head, comprising:

setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other; and making the pulse signals different in timing between the plurality of groups and setting a shift amount of the timing in the pulse signals between the respective groups so as to approximate an integral multiple of an on-pulse peak (AP), wherein the pressure chambers belonging to the plurality of groups are arranged side by side along one pressure chamber column.

15. A program for driving a liquid jet head, the program making a computer perform a process comprising:

setting, when applying at least one pulse signal to a piezoelectric actuator adapted to change a capacity of each of a plurality of pressure chambers communicated respectively with a plurality of nozzles to thereby expand and contract the capacity of the pressure chambers to jet a liquid filling the pressure chamber from the nozzle, the pressure chambers adjacent to each other in the plurality of pressure chambers so as to belong to a plurality of groups different from each other; and making the pulse signals different in timing between the plurality of groups and setting a shift amount of the timing in the pulse signals between the respective groups so as to approximate an integral multiple of an on-pulse peak (AP), wherein the pressure chambers belonging to the plurality of groups are arranged side by side along one pressure chamber column.

* * * * *